US008958895B2

(12) United States Patent
Hiraishi et al.

(10) Patent No.: US 8,958,895 B2
(45) Date of Patent: Feb. 17, 2015

(54) INFORMATION STORAGE MEDIUM AND INFORMATION PROCESSING SYSTEM

(75) Inventors: Hiroyuki Hiraishi, Yokohama (JP); Asuka Shimizu, Tokyo (JP)

(73) Assignee: BANDAI NAMCO Games Inc., Tokyo (JP)

( * ) Notice: Subject to any disclaimer, the term of this patent is extended or adjusted under 35 U.S.C. 154(b) by 721 days.

(21) Appl. No.: 12/896,160

(22) Filed: Oct. 1, 2010

(65) Prior Publication Data

US 2011/0082573 A1 Apr. 7, 2011

(30) Foreign Application Priority Data

Oct. 5, 2009 (JP) ..... 2009-232033

(51) Int. Cl.
*G06F 17/00* (2006.01)
*A63H 5/00* (2006.01)
*A63H 3/28* (2006.01)

(52) U.S. Cl.
CPC ... *A63H 5/00* (2013.01); *A63H 3/28* (2013.01)
USPC ..... 700/94

(58) Field of Classification Search
CPC ..... A63H 3/00; A63H 3/28; A63H 30/04; A63H 5/00; A63H 2200/00
USPC ..... 700/94; 369/1–12; 704/500–504
See application file for complete search history.

(56) References Cited

U.S. PATENT DOCUMENTS

| | | | | |
|---|---|---|---|---|
| 6,773,344 | B1 * | 8/2004 | Gabai et al. | 463/1 |
| 7,505,823 | B1 * | 3/2009 | Bartlett et al. | 700/94 |
| 2010/0167623 | A1 * | 7/2010 | Eyzaguirre et al. | 446/330 |

FOREIGN PATENT DOCUMENTS

JP A-2006-102270 4/2006

* cited by examiner

*Primary Examiner* — Andrew C Flanders
(74) *Attorney, Agent, or Firm* — Posz Law Group, PLC

(57) ABSTRACT

An information processing system includes a storage section that stores a plurality of templates respectively corresponding to a plurality of preset sounds, an acquisition section that acquires external sound data corresponding to an external sound detected by a sound detection section, a determination section that compares the external sound data with each of the plurality of templates, and determines the type of preset sound corresponding to the external sound, and an execution section that executes a process corresponding to the determined type of preset sound.

19 Claims, 19 Drawing Sheets

S8

| | |
|---|---|
| WAVEFORM DATA A (4.0 SECONDS) | TEMPLATE BLOCKS OF BLOCKS A1 TO A8 |
| WAVEFORM DATA B (3.0 SECONDS) | TEMPLATE BLOCKS OF BLOCKS B1 TO B6 |
| WAVEFORM DATA C (11.0 SECONDS) | TEMPLATE BLOCKS OF BLOCKS C1 TO C22 |
| WAVEFORM DATA D (7.0 SECONDS) | TEMPLATE BLOCKS OF BLOCKS D1 TO D14 |

FIG. 8

| | | | | |
|---|---|---|---|---|
| TEMPLATE FOR FIRST TOY | A1+10 | A2+10 | A3+10 | ··· |
| | A1+7.5 | A2+7.5 | A3+7.5 | ··· |
| | A1+5.0 | A2+5.0 | A3+5.0 | ··· |
| | A1+2.5 | A2+2.5 | A3+2.5 | ··· |
| | A1 | A2 | A3 | ··· |
| | A1−2.5 | A2−2.5 | A3−2.5 | ··· |
| | A1−5.0 | A2−5.0 | A3−5.0 | ··· |
| | A1−7.5 | A2−7.5 | A3−7.5 | ··· |
| | A1−10 | A2−10 | A3−10 | ··· |
| TEMPLATE FOR SECOND TOY | B1+10 | B2+10 | B3+10 | ··· |
| | B1+7.5 | B2+7.5 | B3+7.5 | ··· |
| | B1+5.0 | B2+5.0 | B3+5.0 | ··· |
| | B1+2.5 | B2+2.5 | B3+2.5 | ··· |
| | B1 | B2 | B3 | ··· |
| | ··· | ··· | ··· | ··· |

INFORMATION STORAGE MEDIUM AND INFORMATION PROCESSING SYSTEM

Japanese Patent Application No. 2009-232033, filed on Oct. 5, 2009, is hereby incorporated by reference in its entirety.

BACKGROUND OF THE INVENTION

The present invention relates to an information storage medium and an information processing system.

An information processing system that stores a template corresponding to a natural sound (e.g., human voice, animal sound, or object contact sound) in advance, performs a matching process on a natural sound acquired by a microphone and the template to determine the natural sound acquired by the microphone, and performs a process corresponding to the determined sound, has been proposed (JP-A-2006-102270).

Since a natural sound has various patterns, a related-art information processing system stores a large amount (number) of templates, and performs a fine matching process when accurately determining the acquired sound (e.g., when recognizing speech from voice), or otherwise roughly determines the tendency of the acquired sound (see JP-A-2006-102270).

SUMMARY

According to a first aspect of the invention, there is provided an information storage medium storing a program that causes a computer to function as:

a storage section that stores a plurality of templates respectively corresponding to a plurality of preset sounds;

an acquisition section that acquires external sound data corresponding to an external sound detected by a sound detection section;

a determination section that compares the external sound data with each of the plurality of templates, and determines the type of preset sound corresponding to the external sound; and an execution section that executes a process corresponding to the determined type of preset sound.

According to a second aspect of the invention, there is provided an information storage medium storing a program that causes a computer to function as:

a storage section that stores a plurality of templates that respectively correspond to preset sounds generated by a plurality of toys;

an acquisition section that acquires external sound data corresponding to an external sound detected by a sound detection section;

a determination section that compares the external sound data with each of the plurality of templates, and determines the type of toy corresponding to the external sound; and an execution section that executes a process corresponding to the determined type of toy.

According to a third aspect of the invention, there is provided an information processing system comprising:

a storage section that stores a plurality of templates respectively corresponding to a plurality of preset sounds;

an acquisition section that acquires external sound data corresponding to an external sound detected by a sound detection section;

a determination section that compares the external sound data with each of the plurality of templates, and determines the type of preset sound corresponding to the external sound; and an execution section that executes a process corresponding to the determined type of preset sound.

BRIEF DESCRIPTION OF THE SEVERAL VIEWS OF THE DRAWING

FIG. 8 illustrates a method employed for a game system according to one embodiment of the invention.

DETAILED DESCRIPTION OF THE EMBODIMENT

Figure 1:
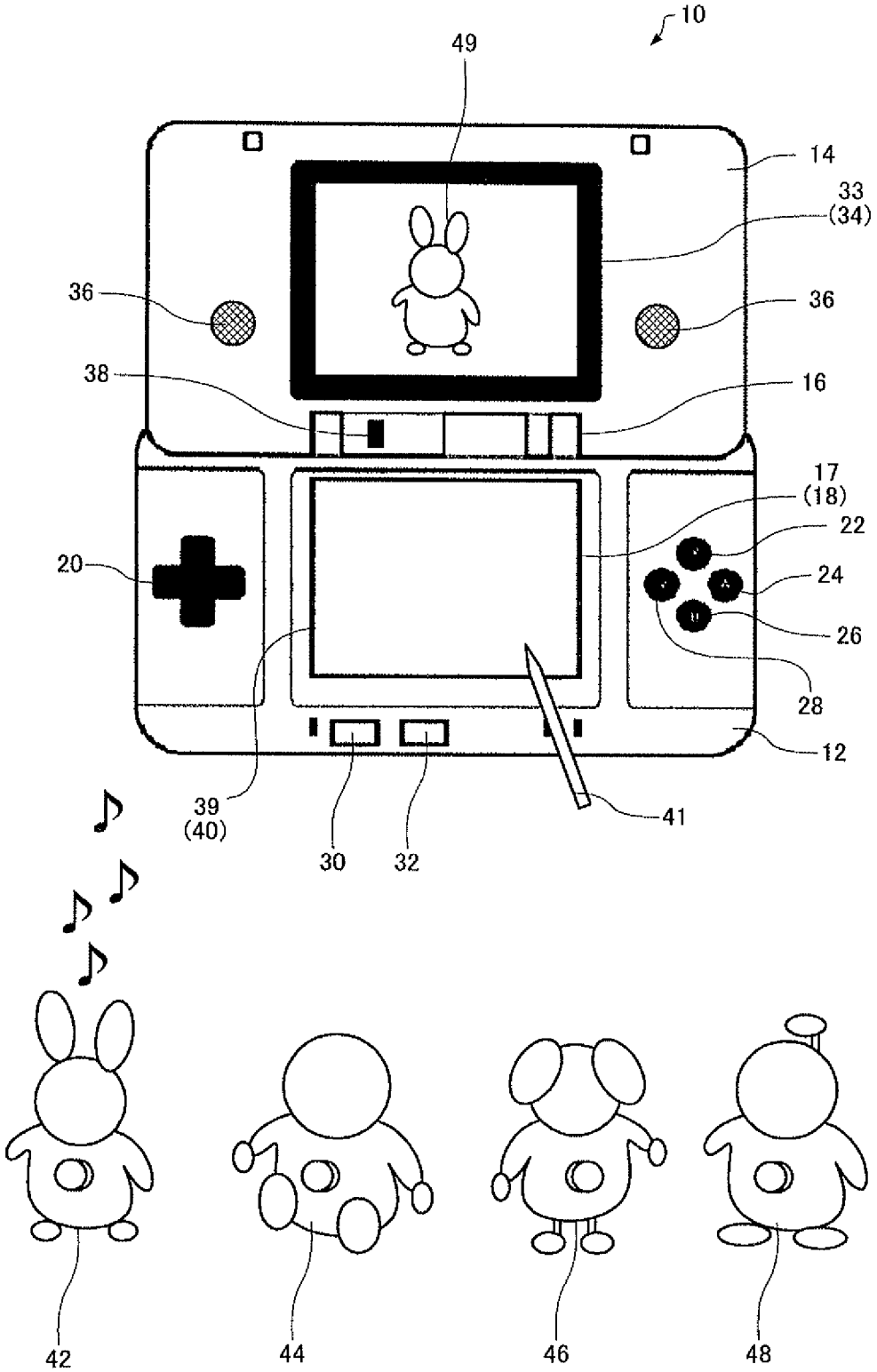
FIG. 1 illustrates the appearance of a game system according to one embodiment of the invention.

The invention may provide an information storage medium and an information processing system that can improve consistency between the acquired sound and the execution target process while controlling the number of templates stored in advance and the amount of the load imposed by the matching process not to become excessive.

(1) One embodiment of the invention relates to an information storage medium storing a program that causes a computer to function as:

a storage section that stores a plurality of templates respectively corresponding to a plurality of preset sounds;

an acquisition section that acquires external sound data corresponding to an external sound detected by a sound detection section;

a determination section that compares the external sound data with each of the plurality of templates, and determines the type of preset sound corresponding to the external sound; and an execution section that executes a process corresponding to the type of preset sound determined by the determination section.

Another embodiment of the invention relates to an information processing system comprising the above sections.

According to the above information storage medium, since the plurality of preset sounds stored in advance as the plurality of templates change in pattern within a narrow range as compared with a natural sound, consistency between the acquired sound and the execution target process can be improved while controlling the number of templates stored in advance and the amount of load imposed by the matching process not to become excessive.

(2) Another embodiment of the invention relates to an information storage medium storing a program that causes a computer to function as:

a storage section that stores a plurality of templates respectively corresponding to a plurality of preset sounds generated by toys;

an acquisition section that acquires external sound data corresponding to an external sound detected by a sound detection section;

a determination section that compares the external sound data with each of the plurality of templates, and determines the type of preset sound corresponding to the external sound; and an execution section that executes a process corresponding to the type of preset sound determined by the determination section.

Another embodiment of the invention relates to an information processing system comprising the above sections.

According to the above information storage medium, since the plurality of preset sounds generated by the plurality of toys change in pattern within a narrow range as compared with a natural sound, consistency between the acquired sound and the execution target process can be can improved while controlling the number of templates stored in advance and the amount of the load imposed by the matching process not to become excessive.

(3) In each of the information storage medium and the information processing system, the storage section may store a plurality of templates that respectively correspond to the plurality of preset sounds reproduced at different reproduction rates as the plurality of templates.

This makes it possible to improve consistency between the acquired sound and the execution target process even if a change in reproduction rate has occurred as a change in pattern of the preset sound.

(4) In each of the information storage medium and the information processing system, the storage section may store a plurality of template blocks respectively corresponding to a plurality of preset sound fragments that correspond to a first period and differ in start timing as each of the plurality of templates, each of the plurality of preset sound fragments forming each of the plurality of preset sounds; the acquisition section may acquire an external sound data block every second period, the external sound data block corresponding to an external sound corresponding to the first period; and the determination section may compare the external sound data block with each of the plurality of template blocks each time the external sound data block is acquired.

According to the above configuration, the type of preset sound corresponding to the external sound can be determined even if part of the external sound data does not correspond to the template due to large noise included in the external sound, for example.

(5) In each of the information storage medium and the information processing system, the plurality of template blocks may respectively correspond to the plurality of preset sound fragments that start at intervals of the first period.

This makes it possible to simplify the process of creating a plurality of template blocks.

(6) In each of the information storage medium and the information processing system, the plurality of template blocks may respectively correspond to the plurality of preset sound fragments that start at intervals of a period corresponding to the reproduction rate.

This makes it possible to reduce a difference in time interval between the external sound data block and the template block even when the reproduction rate of the preset sound is an intermediate value of the reproduction rate determined in advance.

(7) In each of the information storage medium and the information processing system, the determination section may perform a process that selects a template block that satisfies a first condition with respect to the external sound data block, a process that determines whether or not an interval between acquisition timings satisfies a second condition when a template block that satisfies the first condition has been selected with respect to the external sound data block acquired at a different acquisition timing, and a process that determines the type of preset sound corresponding to the external sound based on the type of preset sound corresponding to the selected template block when the second condition has been satisfied.

This makes it possible to determine the type of preset sound corresponding to the external sound based on the time interval that relates to the selected template block.

(8) In each of the information storage medium and the information processing system, the determination section may perform a process that selects a template block that satisfies a first condition with respect to the external sound data block, a process that determines whether or not a difference in serial number between preset sound fragments that respectively correspond to selected template blocks satisfies a third condition when a template block that satisfies the first condition has been selected with respect to the external sound data block acquired at a different acquisition timing, and a process that determines the type of preset sound corresponding to the external sound based on the type of preset sound corresponding to the selected template block when the third condition has been satisfied.

This makes it possible to determine the type of preset sound corresponding to the external sound based on the serial number that relates to the selected template block.

(9) In each of the information storage medium and the information processing system, the determination section may perform a process that selects a template block that satisfies a first condition with respect to the external sound data block, a process that determines whether or not the reproduction rates of preset sound fragments that respectively correspond to selected template blocks satisfy a fourth condition when a template block that satisfies the first condition has been selected with respect to the external sound data block acquired at a different acquisition timing, and a process that determines the type of preset sound corresponding to the external sound based on the type of preset sound corresponding to the selected template block when the fourth condition has been satisfied.

This makes it possible to determine the type of preset sound corresponding to the external sound based on the reproduction rate that relates to the selected template block.

(10) Another embodiment of the invention relates to an information storage medium storing a program that causes a computer to function as:

a storage section that stores a plurality of templates that respectively correspond to preset sounds generated by a plurality of toys;

an acquisition section that acquires external sound data corresponding to an external sound detected by a sound detection section;

a determination section that compares the external sound data with each of the plurality of templates, and determines the type of toy corresponding to the external sound; and an execution section that executes a process corresponding to the type of toy determined by the determination section.

Another embodiment of the invention relates to an information processing system comprising the above sections.

According to the above information storage medium, since the preset sounds generated by the plurality of toys change in pattern within a narrow range as compared with a natural sound, consistency between the acquired sound and the execution target process can be can improved while controlling the number of templates stored in advance and the amount of the load imposed by the matching process not to become excessive.

Embodiments of the invention are described below. Note that the following embodiments do not in any way limit the scope of the invention defined by the claims laid out herein. Note also that all elements described in connection with the following embodiments should not be necessarily taken as essential elements for the invention.

1. OUTLINE OF EMBODIMENTS

FIG. 1 illustrates the appearance of a game system 10 (i.e., information processing system) according to one embodiment of the invention. As illustrated in FIG. 1, the game system 10 is formed to be carried by the player (operator or observer (viewer)). The player holds the game system 10, and plays the game. A lower main body 12 and an upper main body 14 of the game system 10 are connected via a hinge section 16. The lower main body 12 and the upper main body 14 can be rotated around the axis of the hinge section 16. A first liquid crystal display 18 that displays an image on a rectangular first display screen 17 is provided at the center of the lower main body 12. An arrow key 20, first to fourth buttons 22 to 28, a start button 30, and a select button 32 that allow the player to input operation information are provided around the first liquid crystal display 18. A second liquid crystal display 34 that displays an image on a rectangular second display screen 33 is provided at the center of the upper main body 14. A speaker 36 that outputs sound is provided on each side of the second liquid crystal display 34. A microphone 38 that detects an external sound is provided in the hinge section 16.

A touch panel 40 that detects the position of a touch operation performed by the player on a rectangular operation surface 39 is disposed to overlap the first display screen 17 of the first liquid crystal display 18. For example, when the player has brought the tip of a touch pen 41 illustrated in FIG. 1 into contact with the operation surface 39, the game system 10 detects the contact position of the tip of the touch pen 41 with the operation surface 39. This makes it possible for the player to input operation information by performing a touch operation on the operation surface 39.

The game system 10 determines that the player has selected an item displayed on the first display screen 17 depending on the touch position on the operation surface 39, generates a character within the image displayed on the first display screen 17 or the second display screen 33, causes the character to move or disappear, or displays the moving path of the touch position on the operation surface 39 so that the player can draw a character or a picture on the first display screen 17.

Each of a first toy 42 (i.e., shaped body), a second toy 44 (i.e., shaped body), a third toy 46 (i.e., shaped body), and a fourth toy 48 (i.e., shaped body) illustrated in FIG. 1 has the shape of a different character, and includes a sound source IC (e.g., PCM or MIDI sound source) that generates an electronic sound (i.e., preset sound), a speaker, a switch, and a power supply. Each of the first toy 42, the second toy 44, the third toy 46, and the fourth toy 48 generates an electronic sound based on electronic sound data stored in the sound source IC when the switch has been operated, and outputs the generated electronic sound from the speaker. A different type of electronic sound data is stored in the sound source IC of each of the first toy 42, the second toy 44, the third toy 46, and the fourth toy 48. The term "electronic sound" used herein refers to a sound that is electrically output, and includes a sound electrically generated by a synthesizer or the like, and a sound obtained by recording an analog sound (natural sound) (e.g., human voice, animal sound, instrument sound, or object contact sound). The details contained in the electronic sound are not limited.

Specifically, electronic sound data that indicates an electronic sound obtained by combining a recorded human speech sound with an effect sound "a" is stored in the sound source IC of the first toy 42, electronic sound data that indicates an electronic sound of a musical composition "a" is stored in the sound source IC of the second toy 44, electronic sound data that indicates an electronic sound of an effect sound "b" is stored in the sound source IC of the third toy 46, and electronic sound data that indicates an electronic sound of a musical composition "b" is stored in the sound source IC of the fourth toy 48. Therefore, each of the first toy 42, the second toy 44, the third toy 46, and the fourth toy 48 outputs a different type of electronic sound from the speaker.

The game system 10 stores a template that has been created based on the electronic sound output from the first toy 42, a template that has been created based on the electronic sound output from the second toy 44, a template that has been created based on the electronic sound output from the third toy 46, and a template that has been created based on the electronic sound output from the fourth toy 48. When the game system 10 has detected an external sound using the microphone 38, the game system 10 compares the external sound data that indicates the detected external sound with each of the four templates, and determines the type of electronic sound corresponding to the external sound. Note that a situation in which the microphone 38 erroneously detects a sound similar to the speech electronic sound produced by the player is prevented by combining the speech electronic sound with the electronic sound of the effect sound "a".

When the game system 10 has determined that the external sound detected by the microphone 38 is the electronic sound output from one of the toys, the game system 10 changes the image displayed on the first display screen 17 or the second display screen 33 based on the type of the electronic sound determined. For example, when the game system 10 has determined that the external sound detected by the microphone 38 is the electronic sound output from the first toy 42, the game system 10 displays a first character image 49 that indicates the first toy 42 on the second display screen 33. When the game system 10 has determined that the external sound detected by the microphone 38 is the electronic sound output from the second toy 44, the game system 10 displays a second character image that indicates the second toy 44 on the second display screen 33 instead of the first character image 49 that indicates the first toy 42.

Figure 2A:
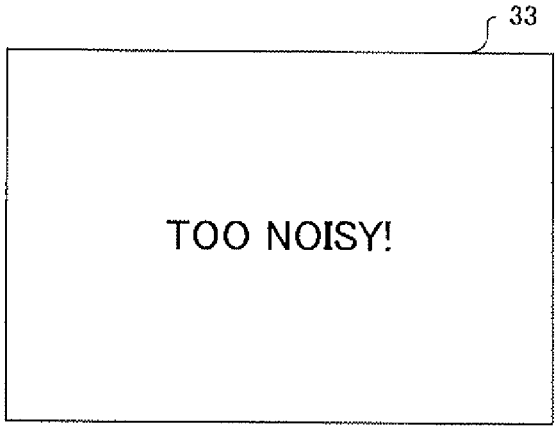
FIGS. 2A to 2C are diagrams illustrating examples of an image displayed on a game system according to one embodiment of the invention.
Figure 2B:
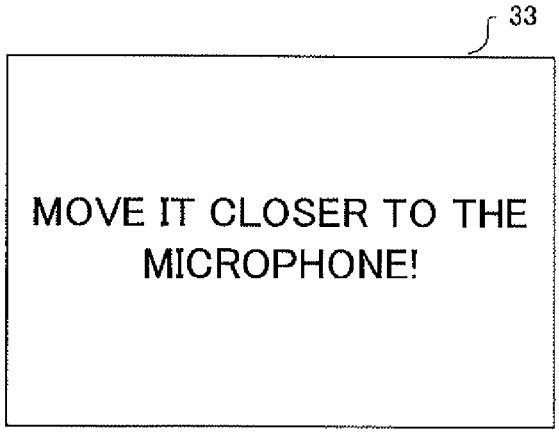
Figure 2C:
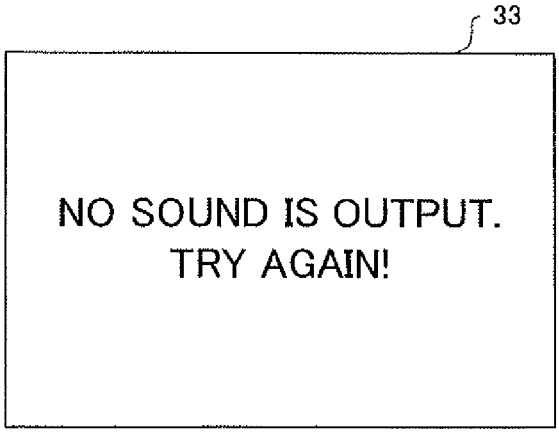

When the game system 10 cannot specify that the external sound detected by the microphone 38 is the electronic sound output from one of the toys even within 30 seconds after the external sound has been detected by the microphone 38, the game system 10 displays an error image on the first display screen 17 based on the volume of the external sound data acquired within 30 seconds after the external sound has been detected by the microphone 38. Specifically, when the volume of the external sound data is continuously high, the game system 10 determines that the type of the electronic sound cannot be determined since the volume of ambient noise is high, and displays a message (e.g., "Too noisy!") that instructs the player to reduce the volume of ambient noise on the second display screen 33 (see FIG. 2A). When the volume of the external sound data is continuously low, the game system 10 determines that the type of the electronic sound cannot be determined since the toy that outputs the electronic sound is positioned away from the microphone 38, and displays a message (e.g., "Move it closer to the microphone!") that instructs the player to move the toy closer to the microphone 38 on the second display screen 33 (see FIG. 2B). When the volume of the external sound data is continuously zero, the game system 10 determines that the type of the electronic sound cannot be determined since the toy has not output an electronic sound, and displays a message (e.g., "No sound is output. Try again!") that instructs the player to cause the toy to output an electronic sound on the second display screen 33 (see FIG. 2C).

2. DETAILS OF METHOD ACCORDING TO THIS EMBODIMENT

2-1. Outline of Template Creation Method

Figure 3:
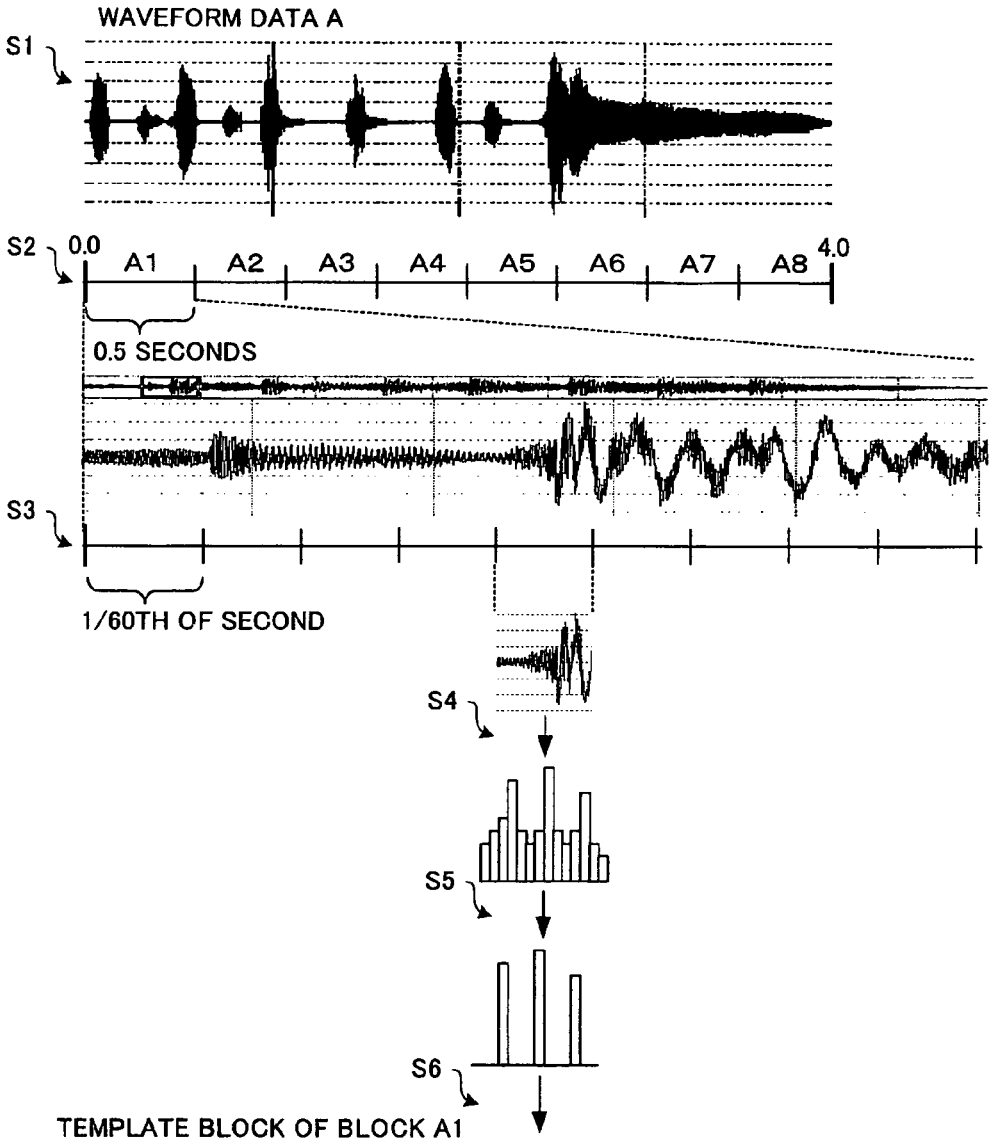
FIG. 3 illustrates a method employed for a game system according to one embodiment of the invention.

FIG. 3 illustrates a method of creating the template that is stored in the game system 10 in advance. FIG. 3 illustrates an example of creating a template corresponding to the electronic sound output from the first toy 42. When creating the template corresponding to the electronic sound output from the first toy 42, waveform data A that is identical with waveform data A stored in the sound source IC of the first toy 42 is acquired (step S1 in FIG. 3). The sampling period of the waveform data A is 4 seconds.

The waveform data A (4 seconds) is divided into eight blocks so that the sampling period of each block is 0.5 seconds to obtain a first block A1 (0.5 seconds (i.e., first period) from the start of the waveform data A) to an eighth block A8 (0.5 seconds at the end of the waveform data A) (step S2). Each of the blocks A1 to A8 is divided into thirty block elements so that the sampling period of each block element is 1/60th of a second (i.e., second period) (step S3). Specifically, the waveform data A (4 seconds) is divided into 240 block elements.

A discrete Fourier transform (DFT) process is performed on the waveform data of each block element to determine the power spectrum of each block element (step S4). The first to third highest frequencies are selected from the power spectrum of each block element (step S5), and stored as template elements of each block element in ascending order (step S6). Note that each frequency (Hz) has been rounded off to the nearest hundred.

The template elements of each block element are stored in time series (step S7). The template elements of the thirty block elements that belong to the block A1 form a template block of the block A1. Likewise, the template elements of the thirty block elements that belong to the blocks A2 to A8 form template blocks of the blocks A2 to A8, respectively. The template blocks of the blocks A1 to A8 are thus obtained as a template corresponding to the waveform data A.

A template corresponding to waveform data B of the electronic sound output from the second toy 44 is obtained in the same manner as described above. Since the reproduction period of the waveform data B is 3 seconds, the waveform data B is divided into blocks B1 to B6 (step S8). Therefore, template blocks of the blocks B1 to B6 are obtained as a template corresponding to the waveform data B. Since the reproduction period of the waveform data C is 11 seconds, template blocks of blocks C1 to C22 are obtained as a template corresponding to the waveform data C (step S8). Since the reproduction period of the waveform data D is 7 seconds, template blocks of blocks D1 to D14 are obtained as a template corresponding to the waveform data D (step S8). Specifically, fifty template blocks (i.e., the template blocks of the blocks A1 to D14) are obtained as the templates corresponding to the waveform data of the electronic sounds of the first to fourth toys 42 to 48.

2-2. Comparison Between Template and External Sound Data

Figure 4:
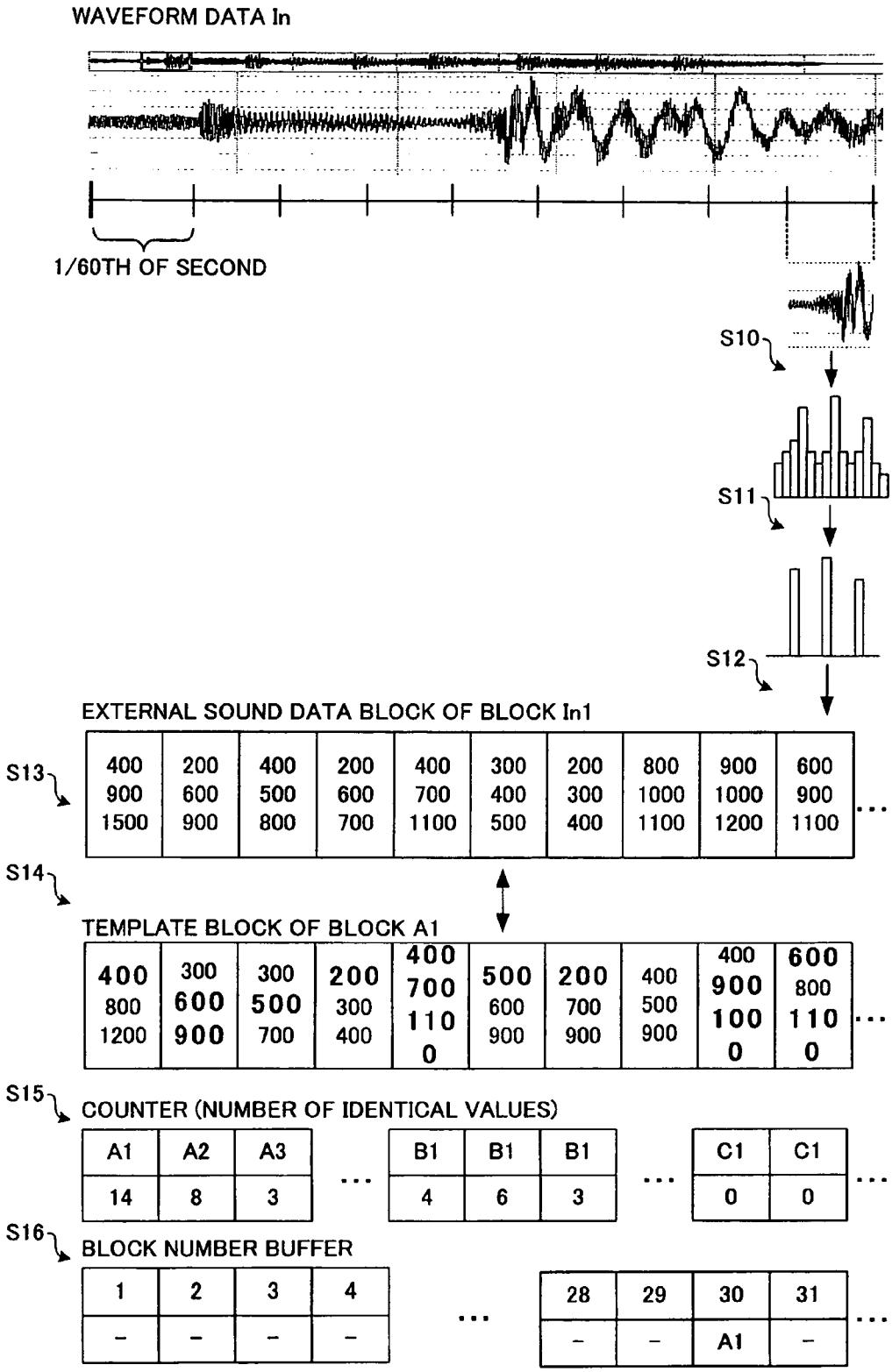
FIG. 4 illustrates a method employed for a game system according to one embodiment of the invention.

FIG. 4 illustrates a method of comparing the templates obtained as described above with external sound data that indicates an external sound detected by the microphone 38. FIG. 4 illustrates an example in which the reproduction rate of the electronic sound output from the first toy 42 is identical with the reproduction rate of the template.

As illustrated in FIG. 4, when the microphone 38 has detected an external sound, and the game system 10 has acquired waveform data In of the external sound, a DFT process is performed on the waveform data corresponding to 1/60th of a second to determine the power spectrum of the waveform data corresponding to 1/60th of a second in the same manner as described above (step S10). Specifically, the power spectrum of each block element that is the waveform data corresponding to 1/60th of a second is determined. The first to third highest frequencies are selected from the power spectrum of each block element (step S11), and stored as external sound data elements of each block element in ascending order (step S12). Note that each frequency (Hz) has been rounded off to the nearest hundred.

The above process is performed on each waveform data corresponding to 1/60th of a second, and the external sound data elements of each block element are stored in time series in an external sound data buffer that can sequentially store the external sound data elements corresponding to 1/60th of a second. When 30/60th of a second (0.5 seconds) has elapsed after the waveform data In of the external sound has been acquired (i.e., when external sound data elements of thirty block elements have been acquired (step S13), the external sound data block of a block In1 thus acquired is compared with each of the template blocks of the blocks A1 to D14 (step S14).

For example, when comparing the external sound data block of the block In1 with the template block of the block A1, the external sound data elements of the first block element (left end in FIG. 4) among the external sound data elements of the thirty block elements of the block In1 are compared with the template elements of the first block element (left end in FIG. 4) among the template elements of the thirty block elements of the block A to determine whether or not an identical value is stored as the external sound data elements and the template elements. Specifically, when 400 Hz, 900 Hz, and 1500 Hz are stored as the external sound data elements of the first block element, and 400 Hz, 800 Hz, and 1200 Hz are stored as the template elements of the first block element, it is determined that one identical value is stored as the external sound data elements and the template elements. Likewise, the external sound data elements of the second and subsequent block elements of the block In1 are compared with the template elements of the second and subsequent block elements of the block A, and the number of identical values stored as the external sound data elements and the template elements is counted. In the example illustrated in FIG. 4, fourteen values (indicated by thick letters) have been determined to be identical between the external sound data block of the block In1 and the template block of the block A1 (step S14).

The external sound data block of the block In1 is also compared with the template block of each of the blocks A2 to D14 to determine coincidence between the external sound data block of the block In1 and the template block of each of the blocks A1 to D14 (step S15). The block number of the template block for which the number of identical values with the external sound data block of the block In1 is a maximum and exceeds a threshold value (10) (i.e., first condition) is selected from the block numbers of the template blocks of the blocks A1 to D14. It is determined that the external sound data block of the block In1 coincides with the template block having the selected block number. In the example illustrated in FIG. 4, since the number of identical values of the template block of the block A1 with the external sound data block of the block In1 is a maximum and exceeds 10, the template block of the block A1 is selected, and it is determined that the external sound data block of the block In1 coincides with the template block of the block A1.

The block number A1 of the selected template block is stored in a block number buffer that can sequentially store the block number of the selected template block in time series (every 1/60th of a second) (step S16). In the example illustrated in FIG. 4, since the template block of the block A1 has been selected when 30/60th of a second (0.5 seconds) has elapsed after the waveform data In of the external sound has been acquired, the block number A1 is stored at the position 30 (corresponding to 30/60th of a second (0.5 seconds)) of the block number buffer.

Figure 5:
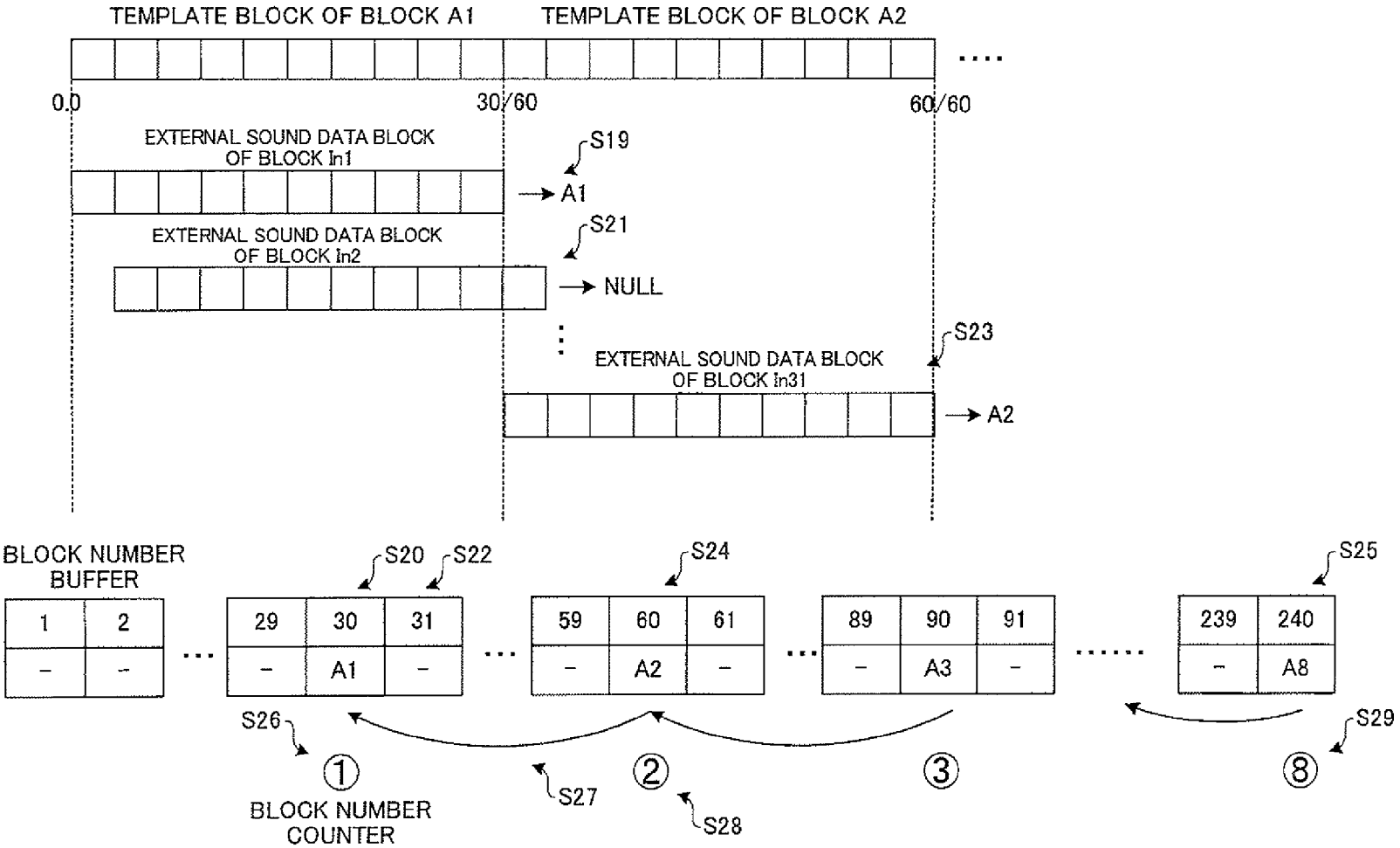
FIG. 5 illustrates a method employed for a game system according to one embodiment of the invention.

As illustrated in FIG. 5 when the block A1 has been selected for the external sound data block of the block In1 corresponding to the waveform data for 30/60th of a second (0.5 seconds) after the waveform data In of the external sound has been acquired (step S19), and the block number A1 has been stored at the position 30 of the block number buffer (step S20), a DFT process is performed on the subsequent waveform data corresponding to 1/60th of a second. The external sound data elements of the subsequent block element corresponding to 1/60th of a second are added to the external sound data block of the block In1, and the external sound data elements of the first block element are deleted (step S21) to acquire the external sound data elements of the thirty block elements (i.e., second to thirty-first block elements) as the external sound data block of a block In2.

The external sound data block of the block In2 is compared with the template block of each of the blocks A1 to D14. Since the serial numbers of the thirty block elements of the external sound data block of the block In2 differ from the serial numbers of the thirty block elements of the external sound data block of the block In1, the number of identical values does not exceed the threshold value (10) when comparing the external sound data elements of the external sound data block of the block In2 with the template elements of the template block of the block A1.

When comparing the external sound data block of the block In2 with the template block of each of the blocks A2 to D14, the number of identical values does not exceed the threshold value (10) since the serial numbers of the block elements of the external sound data block of the block In2 differs from the serial numbers of the block elements of the template block of each of the blocks A2 to D14. Since no template block is selected for the external sound data block of the block In2, it is determined that the external sound data block of the block In2 does not coincide with each template block. Therefore, NULL that indicates that the block number (template block) has not been selected is stored at the position 31 (corresponding to 31/60th of a second) of the block number buffer (step S22).

When 60/60th of a second (1.0 second) has elapsed after the waveform data In of the external sound has been acquired, the external sound data elements of the thirty block elements (i.e., thirty-first to sixtieth block elements) are acquired as the external sound data block of a block In31 (step S23). Since the external sound data block of the block In31 corresponds to the template block of the block A2, the number of identical values is a maximum and exceeds the threshold value (10) when comparing the external sound data block of the block In31 with the template block of the block A2. Therefore, the template block of the block A2 is selected for the external sound data block of the block In31, and the block number A2 of the selected template block is stored at the position 60 (corresponding to 60/60th of a second) of the block number buffer (step S24).

The template block of each of the blocks A1 to A8 corresponds to the waveform data obtained by dividing the waveform data A by 30/60th of a second (0.5 seconds). Therefore, when the reproduction rate of the electronic sound output from the first toy 42 is identical with the reproduction rate of the template, the block numbers A1 to A8 have been stored in the block number buffer in ascending order at intervals of 30/60th of a second (0.5 seconds) when 240/60th of a second (4.0 seconds) has elapsed after the waveform data In of the external sound has been acquired (i.e., when reproduction of the electronic sound output from the first toy 42 has ended) (step S25). Therefore, the game system 10 determines that the waveform data in of the external sound is waveform data corresponding to the block number when a plurality of block numbers stored in the block number buffer correspond to the same type of waveform data, and are stored in ascending order at intervals of 30/60th of a second (0.5 seconds).

When the block number "A1" has been stored in the block number buffer in a state in which no block number is stored in the block number buffer (step S20), the game system 10 increments the count value of a block number counter by one (step S26). When the block number "A2" has been stored in the block number buffer (step S24), the game system 10 searches the block number stored at the position that precedes the storage position of the block number "A2" by 30 frames (step S27). The game system 10 compares the searched block number "A1" with the block number "A2" thus searched. Specifically, the game system 10 compares the latest block number with the block number that has been stored at a timing that precedes the storage timing of the latest block number by 30/60th of a second (0.5 seconds).

When the block numbers correspond to the same type of waveform data, and the difference (in serial number) between the block numbers is one, the game system 10 increments the count value of the block number counter by one. In the example illustrated in FIG. 5, since the block numbers "A1" and "A2" correspond to the waveform data A, and the difference (in serial number) between the block numbers "A1" and "A2" is one, the game system 10 increments the count value of the block number counter by one (i.e., count value=2) (step S28). When the count value of the block number has reached "8" (step S29), the game system 10 determines that eight template blocks corresponding to the waveform data A are stored in ascending order, and determines that the waveform data In of the external sound is the waveform data A.

2-3. Template Creation Method that Deals with Change in Reproduction Rate

Since the oscillation frequency of the oscillation circuit of the sound source IC may differ between the first to fourth toys 42 to 48, the reproduction rate of the electronic sound may differ between the first to fourth toys 42 to 48. Therefore, the reproduction rate of the electronic sound may differ between a plurality of toys of the same type. For example, an electronic sound reproduced at a reproduction rate of +10% is output from a first toy 42 that includes a sound source IC having an oscillation frequency higher than that of a reference value by 10%, and an electronic sound reproduced at a reproduction rate of −10% is output from a first toy 42 that includes a sound source IC having an oscillation frequency lower than that of a reference value by 10%.

Figure 6:
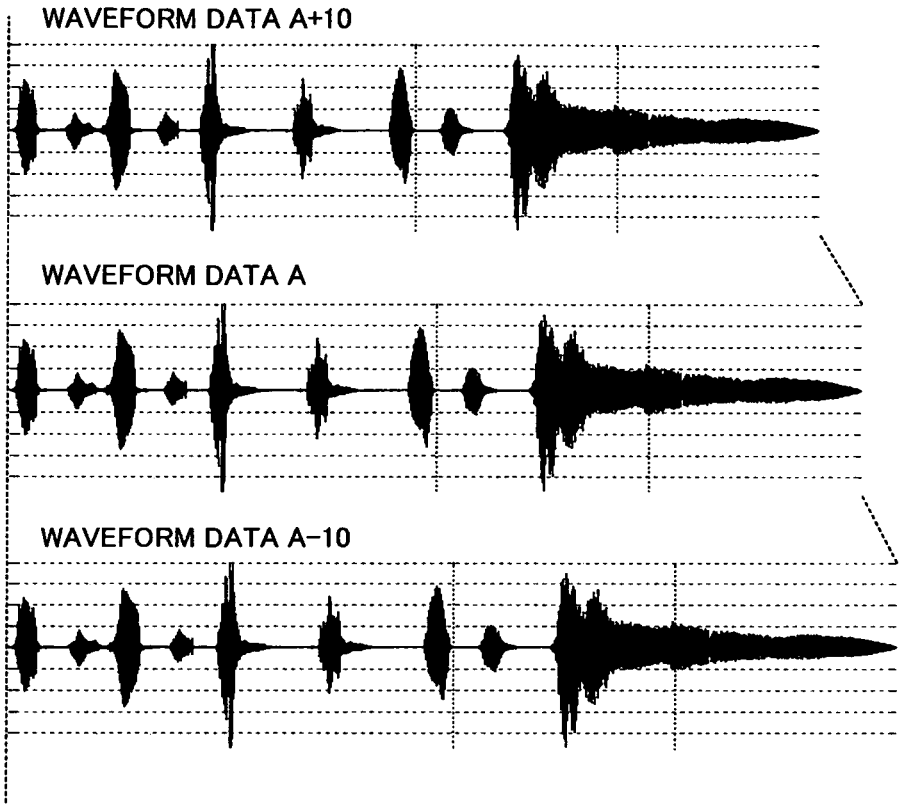
FIG. 6 illustrates a method employed for a game system according to one embodiment of the invention.

FIG. 6 illustrates the waveform data of the electronic sound output from the first toy 42 that may be acquired by the game system 10. Waveform data A+10 in FIG. 6 (upper side) indicates waveform data when the reproduction rate of the electronic sound output from the first toy 42 has increased by 10%, and waveform data A−10 in FIG. 6 (lower side) indicates waveform data when the reproduction rate of the electronic sound output from the first toy 42 has decreased by 10%. As illustrated in FIG. 6, the interval of the waveform data A+10 is higher than that of waveform data A (original waveform) by 10, and the length of the waveform of the waveform data A+10 is shorter than that of the waveform data A by 10%. The interval of the waveform data A−10 is lower than that of the waveform data A by 10, and the length of the waveform of the waveform data A−10 is longer than that of the waveform data A by 10%.

Therefore, when the game system 10 has acquired the waveform data A+10 or the waveform data A−10, acquired an external sound data block of a block In corresponding to 30/60th of a second (0.5 seconds) by performing a DFT process, and compared the external sound data block of the block In with the template block of each of the blocks A1 to D14, the number of identical values does not exceed the threshold value (10). Therefore, the block number of a template block corresponding to the external sound data block of the block In cannot be selected. Specifically, when the game system 10 has acquired the waveform data A+10 or the waveform data A−10, the game system 10 cannot determine that the waveform data In of the external sound is the waveform data A corresponding to the block number A.

If the threshold value of the number of identical values between the external sound data block and the template block is reduced so that the game system 10 can determine that the waveform data In of the external sound is the waveform data A corresponding to the block number A even when the game system 10 has acquired the waveform data A+10 or the waveform data A−10, the game system 10 is likely to determine that the external sound data coincides with a wrong template. In order to deal with this problem, the game system 10 creates and stores templates corresponding to the waveform data A+10 and the waveform data A−10 in addition to the template corresponding to the waveform data A.

Figure 7:
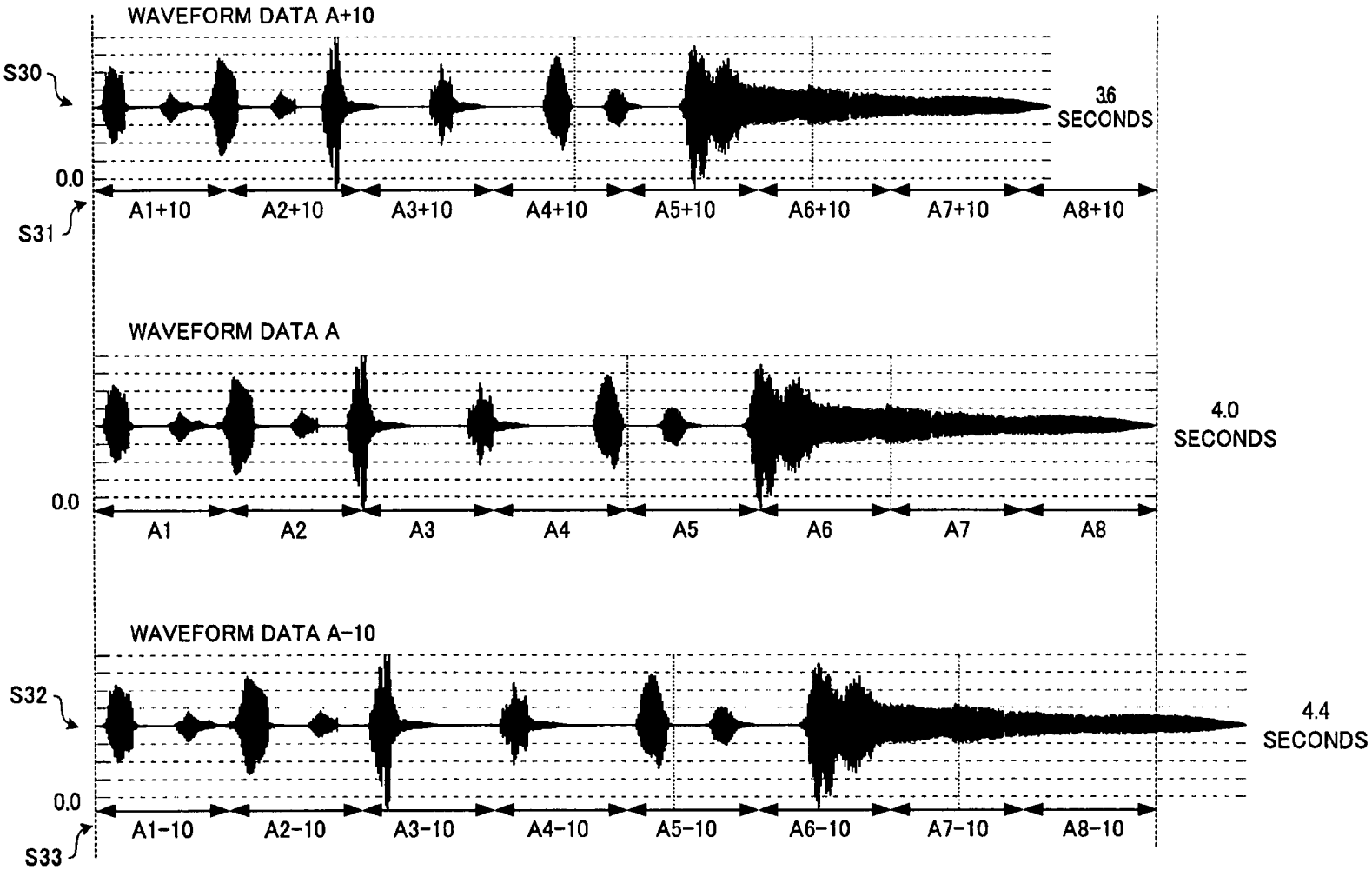
FIG. 7 illustrates a method employed for a game system according to one embodiment of the invention.

FIG. 7 illustrates a method of creating a template corresponding to each of a plurality of pieces of waveform data that differs in reproduction rate. FIG. 7 illustrates an example of creating a template corresponding to the electronic sound output from the first toy 42. A template corresponding to waveform data when the reproduction rate of the electronic sound output from the first toy 42 is ±0% with respect to the original sound includes template blocks of blocks A1 to A8 corresponding to waveform data of eight blocks obtained by dividing the waveform data A (sampling period: 4.0 seconds) (center in FIG. 7) so that the sampling period of one block is 0.5 seconds.

When creating a template corresponding to the waveform data when the reproduction rate of the electronic sound output from the first toy 42 is +10% with respect to the original sound, the waveform data A+10 is obtained by converting the waveform data A (original sound) so that the sampling rate is +10% (step S30 in FIG. 7). The sampling period of the waveform data A+10 is 3.6 seconds.

The waveform data A+10 (3.6 seconds) is divided into eight blocks so that the sampling period of each block is 0.5 seconds to obtain a first block A1+10 (0.5 seconds from the start of the waveform data A+10) to an eighth block A8+10 (0.5 seconds at the end of the waveform data A+10) (step S31). Each of the blocks A1+10 to A8+10 is divided into thirty block elements so that the sampling period of each block element is 1/60th of a second in the same manner as in the case of creating a template corresponding to the waveform data A (step S3 in FIG. 3). Specifically, the waveform data A+10 (3.6 seconds) and blank data (0.4 seconds) are divided into 240 block elements.

Template elements of each block element are determined from the waveform data of each block element. The template elements of the thirty block elements that belong to the block A1+10 form a template block of the block A1+10. Likewise, the template elements of the thirty block elements that belong to the blocks A2+10 to A8+10 form template blocks of the blocks A2+10 to A8+10, respectively. The template blocks of the blocks A1+10 to A8+10 are thus obtained as a template corresponding to the waveform data A+10. Note that the template elements of the block element of the blank data (0.4 seconds) at the end of the eighth block A8+10 are "0".

When creating a template corresponding to the waveform data when the reproduction rate of the electronic sound output from the first toy 42 is −10% with respect to the original sound, the waveform data A−10 is obtained by converting the waveform data A (original sound) so that the sampling rate is −10% (step S32 in FIG. 7). The sampling period of the waveform data A−10 is 4.4 seconds.

The waveform data A−10 (4.4 seconds) is divided into eight blocks so that the sampling period of each block is 0.5 seconds to obtain a first block A1−10 (0.5 seconds from the start of the waveform data A−10) to an eighth block A8−10 (0.5 seconds at the end of the waveform data A−10) (step S33). Each of the blocks A1−10 to A8−10 is divided into thirty block elements so that the sampling period of each block element is 1/60th of a second in the same manner as in the case of creating a template corresponding to the waveform data A (step S3 in FIG. 3). Specifically, waveform data corresponding to 4.0 seconds included in the waveform data A−10 (4.4 seconds) is divided into 240 block elements.

Template elements of each block element are determined from the waveform data of each block element. The template elements of the thirty block elements that belong to the block A1−10 form a template block of the block A1−10. Likewise, the template elements of the thirty block elements that belong to the blocks A2−10 to A8−10 form template blocks of the blocks A2−10 to A8−10, respectively. The template blocks of the blocks A1−10 to A8−10 are thus obtained as a template corresponding to the waveform data A−10. Since the sampling period of the waveform data A−10 is 4.4 seconds, a template block is not created for the waveform data corresponding to 0.4 seconds at the end of the waveform data A−10.

As illustrated in FIG. 7, the shape of the waveform data of the fifth block A5+10 of the waveform data A+10, the shape of the waveform data of the fifth block A5 of the waveform data A, and the shape of the waveform data of the fifth block A5−10 of the waveform data A−10 (i.e., the waveform data of a plurality of blocks that are identical in the type of waveform data and the block number, but differ in sampling rate) differ to a large extent. Specifically, since the start timing of each block occurs every 0.5 seconds even if the sampling rate of the waveform data A is changed, the waveform data corresponding to the start timing differs between a plurality of blocks having the above relationship. The difference in shape of the waveform data between a plurality of blocks having the above relationship increases as the block number increases (i.e., as the block is positioned away from the head of the waveform data).

In this embodiment, a template corresponding to the waveform data when the reproduction rate of the electronic sound output from the first toy 42 is +7.5%, +5.0%, +2.5%, −2.5%, −5.0%, or −7.5% is also created by the above method. Specifically, as illustrated in FIG. 8, templates corresponding to waveform data A+10, waveform data A+7.5, waveform data A+5.0, waveform data A+2.5, waveform data A, waveform data A−2.5, waveform data A−5.0, waveform data A−7.5, and waveform data A−10 are created as templates for specifying the electronic sound output from the first toy 42, and template blocks of blocks A1 to A8 are created for each template.

Likewise, templates corresponding to waveform data 13+10, waveform data B+7.5, waveform data B+5.0, waveform data B+2.5, waveform data B, waveform data B−2.5, waveform data B−5.0, waveform data B−7.5, and waveform data B−10 are created as templates for specifying the electronic sound output from the second toy 44, and template blocks of blocks B1 to 86 are created for each template. Templates corresponding to waveform data C+10, waveform data C+7.5, waveform data C+5.0, waveform data C+2.5, waveform data C, waveform data C−2.5, waveform data C−5.0, waveform data C−7.5, and waveform data C−10 are created as templates for specifying the electronic sound output from the third toy 46, and template blocks of blocks C1 to C22 are created for each template. Templates corresponding to waveform data D+10, waveform data D+7.5, waveform data D+5.0, waveform data D+2.5, waveform data D, waveform data D−2.5, waveform data D−5.0, waveform data D−7.5, and waveform data D−10 are created as templates for specifying the electronic sound output from the fourth toy 48, and template blocks of blocks D1 to D14 are created for each template. Specifically, 450 template blocks (i.e., the template blocks of the blocks A1+10 to D14−10) are created as the template blocks corresponding to the waveform data of the electronic sounds of the first to fourth toys 42 to 48.

2-4. Comparative Method that Deals with Change in Reproduction Rate

In the comparative process described with reference to FIG. 4, the external sound data block of the block In is compared with each of the 450 template blocks (i.e., the template blocks of the blocks A1+10 to D14−10) every 1/60th of a second. For example, when the game system 10 has acquired the waveform data A+10, the game system 10 acquires an external sound data block of a first block In1 (30/60th of a second (0.5 seconds)) by performing a DFT process on the waveform data A+10 in the same manner as in the comparative process described with reference to FIG. 4. The game system 10 compares the external sound data block of the block In1 with each of the 450 template blocks (i.e., the template blocks of the blocks A1+10 to D14−10). The game system 10 determines that the number of identical values of the external sound data block of the block In1 with the template block of the block A1+10 is a maximum and exceeds the threshold value (10). Therefore, the template block of the block A1+10 is selected for the external sound data block of the block In1, and the block number A1+10 of the selected template block is stored at the position 30 (corresponding to 30/60th of a second) of the block number buffer.

The template block of each of the blocks A1+10 to A8+10 corresponds to the waveform data obtained by dividing the waveform data A+10 by 30/60th of a second (0.5 seconds). Therefore, the block numbers A1+10 to A8+10 are stored in the block number buffer in ascending order at intervals of 30/60th of a second (0.5 seconds) when 240/60th of a second (4.0 seconds) has elapsed after the waveform data In of the external sound has been acquired in the same manner as in the example illustrated in FIG. 5.

Therefore, when the game system 10 has acquired the waveform data A+10, the game system 10 can determine that the waveform data In of the external sound is the waveform data A corresponding to the block number A. Specifically, the game system 10 can specify the type of electronic sound corresponding to the external sound detected by the microphone 38 even if the reproduction rate of the electronic sound output from the first to fourth toys 42 to 48 has changed.

However, since the reproduction rate of the electronic sound output from the first to fourth toys 42 to 48 does not gradually change, differing from the sampling rate of the template block, waveform data at an intermediate reproduction rate with respect to the sampling rate of the template block (e.g., waveform data for which the reproduction rate of the electronic sound output from the first toy 42 is +6.25% with respect to the original sound) may be acquired. Therefore, when waveform data of the electronic sound of one of the first to fourth toys 42 to 48 at an intermediate reproduction rate with respect to the sampling rate of the template block has been acquired, the threshold value of the number of identical values between the external sound data block and the template block is determined in the comparative process illustrated in FIG. 4 so that the block number of a template block for which the sampling rate is close to the reproduction rate is selected. For example, when waveform data A+6.25 for which the reproduction rate is +6.25% with respect to the waveform data A has been acquired, one of the template block of the first block A1+5.0 corresponding to the waveform data A+5.0 (sampling rate: +5.0%) and the template block of the first block A1+7.5 corresponding to the waveform data A+7.5 (sampling rate: +7.5%) for which the number of identical values is higher than the other, is selected for the external sound data block of the first block In1.

Figure 9:
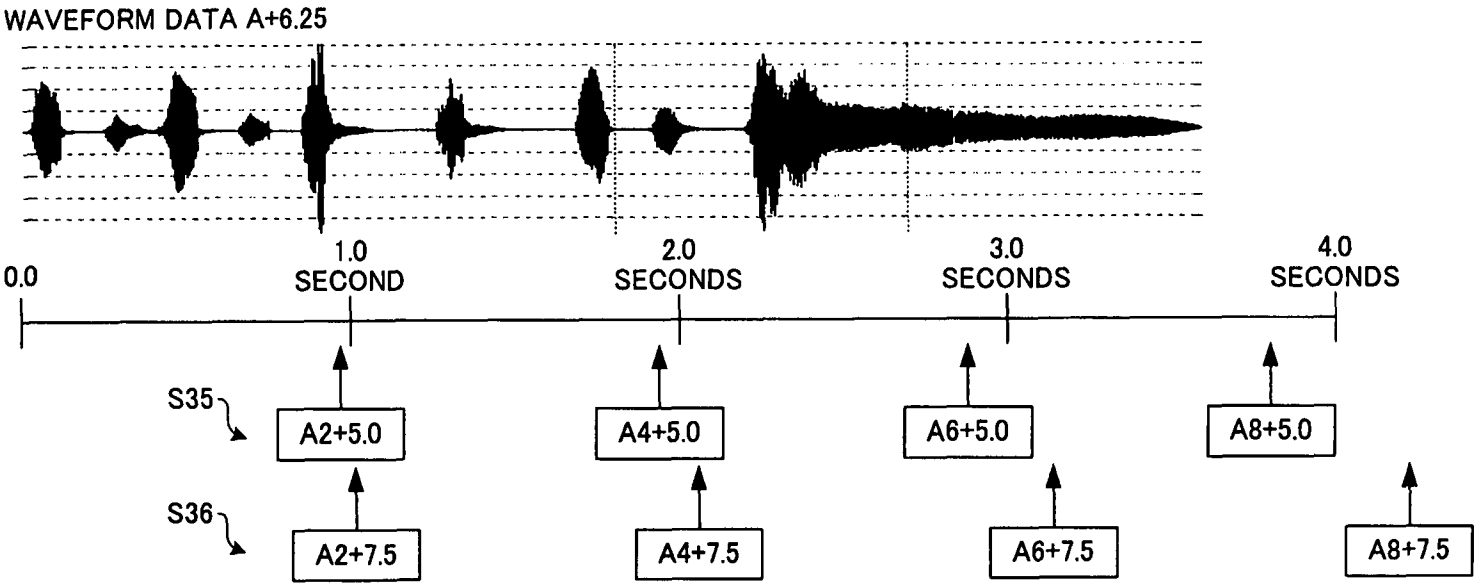
FIG. 9 illustrates a method employed for a game system according to one embodiment of the invention.

FIG. 9 illustrates the template block selection timing when the waveform data A+6.25 has been acquired. When the waveform data A+6.25 has been acquired, a template block corresponding to the waveform data A+6.25 is selected every 30/60th of a second (0.5 seconds) when a template block corresponding to the waveform data A+6.25 is provided. However, when a template block corresponding to the waveform data A+6.25 is not provided, and a template block corresponding to the waveform data A+5.0 is selected (step S35 in FIG. 9), the template block corresponding to the waveform data A+5.0 is selected at an interval shorter than 30/60th of a second (0.5 seconds) by 1.25% since the sampling rate of the template block corresponding to the waveform data A+5.0 is lower than that of the external sound data block of the waveform data A+6.25 by 1.25%. On the other hand, a template block corresponding to the waveform data A+7.5 is selected at an interval longer than 30/60th of a second (0.5 seconds) by 1.25% (step S36) since the sampling rate of the template block corresponding to the waveform data A+7.5 is higher than that of the external sound data block of the waveform data A+6.25 by 1.25%.

When a template block corresponding to the waveform data A+5.0 and a template block corresponding to the waveform data A+7.5 are alternately selected for the waveform data A+6.25 (step S37 in FIG. 10), a situation in which the template block is selected at an interval longer than 30/60th of a second (0.5 seconds) and a situation in which the template block is selected at an interval shorter than 30/60th of a second (0.5 seconds) occur alternately. The interval between the selection timings of the template blocks further deviates from 30/60th of a second (0.5 seconds) with the lapse of time after the waveform data A+6.25 has been acquired. Specifically, an error of the interval between the selection timings of the template blocks increases as the block number increases.

In this case, the block number "A1+5.0" of the initially selected template block is stored at the position 30 of the block number buffer (step S38), and the block number "A2+7.5" of the subsequently selected template block is stored at the position 61 of the block number buffer (step S39). Therefore, the interval between "A1+5.0" and "A2+7.5" is 31 (=61−30) frames. Since the block number "A3+5.0" of the subsequently selected template block is stored at the position 89 of the block number buffer (step S40), the interval between "A2+7.5" and "A3+5.0" is 28 (=89−61) frames.

The block number "A6+7.5" of the subsequently selected template block is stored at the position 183 of the block number buffer (step S41), and the block number "A7+5.0" of the subsequently selected template block is stored at the position 208 of the block number buffer (step S42). Therefore, the interval between "A6+7.5" and "A7+5.0" is 25 frames. Since the block number "A8+7.5" of the subsequently selected template block is stored at the position 243 of the block number buffer (step S43), the interval between "A7+5.0" and "A8+7.5" is 35 (=243−208) frames.

When comparing the external sound data block corresponding to the actual external sound with the template block, an error of the interval between the selection timings of the template blocks occurs by several frames due to surrounding noise, a DFT process, and the like. In order to deal with this problem, the game system 10 searches the block number stored at the position that precedes the storage position of the latest block number by 30 frames (see FIG. 5), and also searches a block number stored within a range of "d=5+N" frames around the position that precedes the storage position of the latest block number by 30 frames. Note that "5" is a constant defined taking account of an error by several frames that occurs due to surrounding noise, a DFT process, and the like, and the order of the template block indicated by the latest block number is substituted for N taking account of an error that increases as the block number increases.

Specifically, when the block number "A1+5.0" has been stored in the block number buffer in a state in which no block number is stored in the block number buffer (step S38 in FIG. 10), the game system 10 increments the count value of the block number counter by one (step S44). When the block number "A2+7.5" has been stored in the block number buffer (step S39), the game system 10 searches a block number (i.e., second condition) stored within a range of 7 (=d=5+2) frames around the position that precedes the storage position of the latest block number "A2+7.5" by 30 frames (step S45). Specifically, the game system 10 searches a block number stored within a range from the position 24 that precedes the position 61 (where the latest block number "A2+7.5" is stored) by 37 frames to the position 38 that precedes the position 61 by 23 frames. The game system 10 then finds the block number "A1+5.0" stored at the position 30.

The game system 10 compares the searched block number "A1+5.0" with the latest block number "A2+7.5", and determines whether or not the type of template block indicated by the block number "A1+5.0" coincides with the type of template block indicated by the latest block number "A2+7.5", the difference in serial number between the block number "A1+5.0" and the latest block number "A2+7.5" is one (i.e., third condition), and the difference between the sampling rate indicated by the block number "A1+5.0" and the sampling rate indicated by the latest block number "A2+7.5" is 2.5% or less (i.e., fourth condition). When the searched block number "A1+5.0" and the latest block number "A2+7.5" satisfy the above conditions, the game system 10 determines the range (rmax to rmin) of the reproduction rate of the electronic sound that may be actually output from the first toy 42 using the sampling rate indicated by the latest block number (e.g., rmax=R+2.5%, rmin=R−2.5%). In the example in FIG. 10, the difference in serial number between the searched block number "A1+5.0" and the latest block number "A2+7.5" is one, the difference in sampling rate between the searched block number "A1+5.0" and the latest block number "A2+7.5" is 2.5% or less, and the sampling rate indicated by the latest block number "A2+7.5" is 107.5%. Therefore, the game system 10 determines that rmax=110.0% and rmin=105.0%.

The game system 10 then calculates an interval Dmax at which the block number is stored in the block number buffer when waveform data for which the reproduction rate is rmax has been detected, and an interval Dmin at which the block number is stored in the block number buffer when waveform data for which the reproduction rate is rmin has been detected, using the expressions "Dmax=(B/rmax)(RN−R'N')" and "Dmin=(B/rmin)(RN−R'N')" (where, B is the interval (30 frames) in an ideal state, R is the sampling rate indicated by the latest block number, N is the serial number indicated by the latest block number, R' is the sampling rate indicated by the searched block number, and N' is the serial number indicated by the searched block number). The term "ideal state" refers to a state in which each of the electronic sound reproduction rate of the sound source IC of the first toy 42, the detection properties of the microphone 38 of the game system 10, the positional relationship, the temperature, and the like when the microphone 38 has detected the electronic sound output from the first toy 42 is a reference value.

Figure 10:
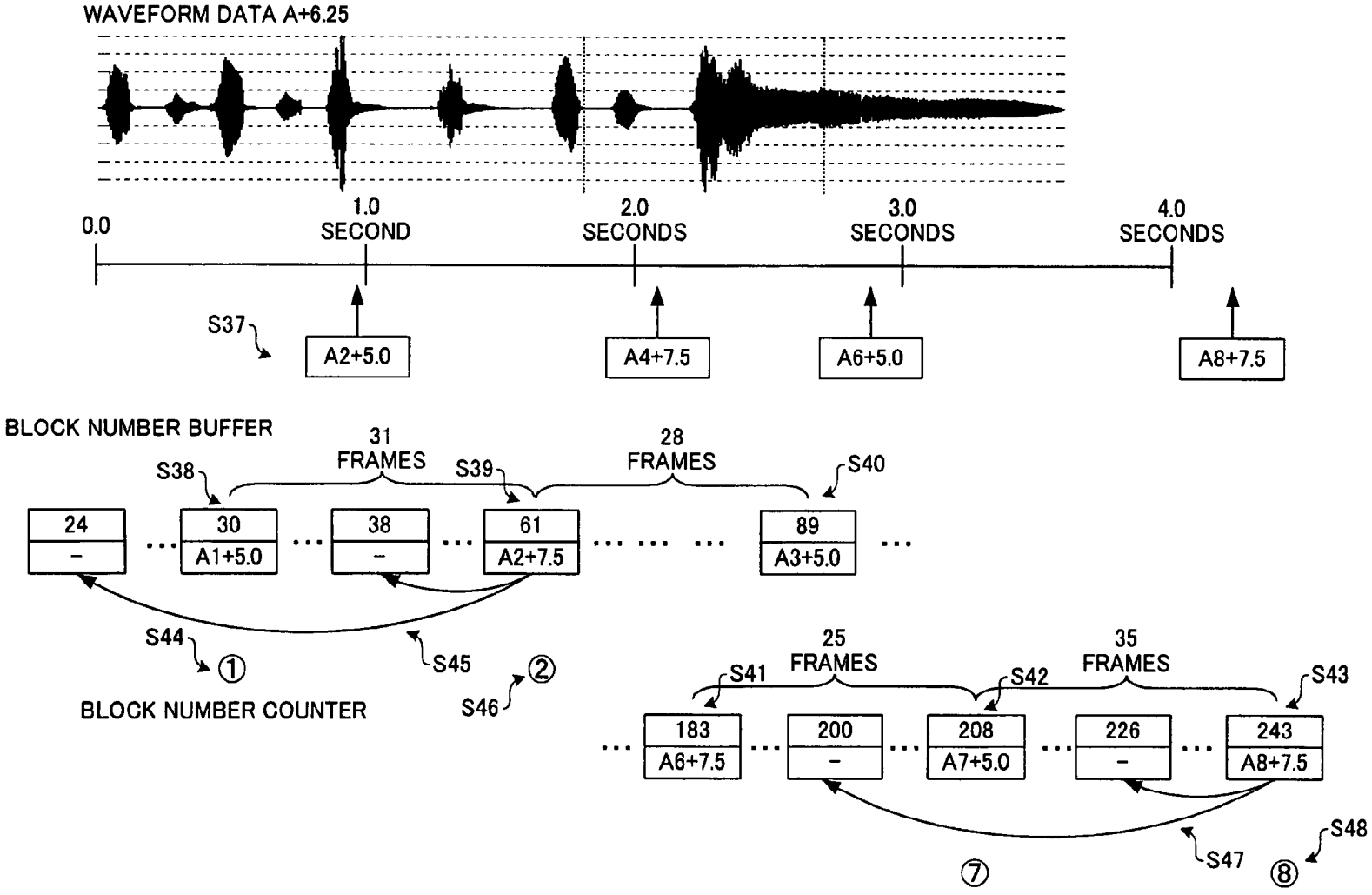
FIG. 10 illustrates a method employed for a game system according to one embodiment of the invention.

In the example in FIG. 10, the sampling rate R indicated by the latest block number "A2+7.5" is 107.5%, the serial number N indicated by the latest block number "A2+7.5" is 2, the sampling rate R' indicated by the searched block number "A1+5.0" is 105.0%, and the serial number N' indicated by the searched block number "A1+5.0" is 1. Therefore, Dmax is (30/110.0)(107.5·2−105.0·1)=30, and Dmin is (30/105.0)(107.5·2−105.0·1)=31.43.

The game system 10 then determines whether or not the actual interval between the searched block number "A1+5.0" and the latest block number "A2+7.5" in the block number buffer is included within the range from Dmax to Dmin. In the example in FIG. 10, since the actual interval between the searched block number "A1+5.0" and the latest block number "A2+7.5" in the block number buffer is 31 (=61−30) frames, the actual interval between the searched block number "A1+5.0" and the latest block number "A2+7.5" is included within the range from Dmax to Dmin (Dmax=30 to Dmin=31.43).

Therefore, the game system 10 determines that the template block having the searched block number "A1+5.0" and the template block having the latest block number "A2+7.5" correspond to part of the waveform data A reproduced at a reproduction rate within the range from +5.0% to +7.5%, and increments the count value of the block number counter by one (i.e., count value=2) (step S46).

When the block number "A8+7.5" has been stored in the block number buffer (step S43), the game system 10 searches a block number stored within a range of 13 (=d=5+8) frames around the position that precedes the storage position of the latest block number "A8+7.5" by 30 frames (step S47). Specifically, the game system 10 searches a block number stored within a range from the position 200 that precedes the position 243 (where the latest block number "A8+7.5" is stored) by 43 frames to the position 226 that precedes the position 243 by 17 frames.

The game system 10 compares the searched block number "A7+5.0" with the latest block number "A8+7.5", and determines whether or not the type of template block indicated by the searched block number "A7+5.0" coincides with the type of template block indicated by the latest block number "A8+7.5", the difference in serial number between the searched block number "A7+5.0" and the latest block number "A8+7.5" is one, and the difference between the sampling rate indicated by the searched block number "A7+5.0" and the sampling rate indicated by the latest block number "A8+7.5" is 2.5% or less. When the searched block number "A7+5.0" and the latest block number "A8+7.5" satisfy the above conditions, the game system 10 determines the range (rmax to rmin) of the reproduction rate of the electronic sound that may be actually output from the first toy 42. In the example in FIG. 10, the searched block number "A7+5.0" and the latest block number "A8+7.5" satisfy the above conditions, and the sampling rate R indicated by the latest block number "A8+7.5" is 107.5%. Therefore, the game system 10 determines that rmax=110.0% and rmin=105.0%.

The game system 10 then calculates the interval Dmax at which the block number is stored in the block number buffer when waveform data for which the reproduction rate is rmax has been detected, and the interval Dmin at which the block number is stored in the block number buffer when waveform data for which the reproduction rate is rmin has been detected. In the example in FIG. 10, the sampling rate R indicated by the latest block number "A8+7.5" is 107.5%, the serial number N indicated by the latest block number "A8+7.5" is 8, the sampling rate R' indicated by the searched block number "A7+5.0" is 105.0%, and the serial number N' indicated by the searched block number "A7+5.0" is 7. Therefore, Dmax is (30/110.0)(107.5·8−105.0·7)=34.09, and Dmin is (30/105.0)(107.5·8−105.0·7)=35.71.

The game system 10 then determines whether or not the actual interval between the searched block number "A7+5.0" and the latest block number "A8+7.5" in the block number buffer is included within the range from Dmax to Dmin. In the example in FIG. 10, since the actual interval between the searched block number "A7+5.0" and the latest block number "A8+7.5" in the block number buffer is 35 (=243−208) frames, the actual interval between the searched block number "A7+5.0" and the latest block number "A8+7.5" is included within the range from Dmax to Dmin (Dmax=34.09 to Dmin=35.71).

Therefore, the game system 10 determines that the template block having the searched block number "A7+5.0" and the template block having the latest block number "A8+7.5" correspond to part of the waveform data A reproduced at a reproduction rate within the range from +5.0% to +7.5%, and increments the count value of the block number counter by one (i.e., count value=8) (step S48).

When the count value of the block number has reached "8" (step S48), the game system 10 determines that eight template blocks corresponding to the waveform data A are stored in ascending order. In the example in FIG. 10, the game system 10 can specify that the waveform data In of the external sound is the waveform data A even if an error has occurred due to surrounding noise, a DFT process, and the like, or an error that increases as the block number increases has occurred.

When using the method according to this embodiment, when the microphone 38 has detected large noise when detecting the electronic sound output from the first toy 42, for example, no block number may be stored in the block number buffer at the position where the second block number should be stored, or a block number that does not satisfy the above condition (type of template block, serial number, or sampling rate) may be stored in the block number buffer. In this case, the count value of the block number counter is not incremented by one. In this embodiment, even if some of the block numbers corresponding to the waveform data A cannot be counted, the game system 10 determines that the waveform data In of the external sound is the waveform data A when the relationship between a plurality of other block numbers satisfies predetermined conditions.

Specifically, when the block number "B3−2.5" has been stored at the position 61 of the block number buffer (step S50 in FIG. 11), the game system 10 searches a block number stored within a range of 8 (=d=5+3) frames around the position that precedes the storage position of the latest block number "B3−2.5" by 30 frames (step S51). Specifically, the game system 10 searches a block number stored within a range from the position 23 that precedes the position 61 (where the latest block number "B3−2.5" is stored) by 38 frames to the position 39 that precedes the position 61 by 22 frames.

The game system 10 compares the searched block number "A1+5.0" (position 30) with the latest block number "B3−2.5", and determines whether or not the type of template block indicated by the searched block number "A1+5.0" coincides with the type of template block indicated by the latest block number "B3−2.5", the difference in serial number between the searched block number "A1+5.0" and the latest block number "B3−2.5" is one, and the difference between the sampling rate indicated by the searched block number "A1+5.0" and the sampling rate indicated by the latest block number "B3−2.5" is 2.5% or less. In the example in FIG. 11, the type of template block indicated by the searched block number "A1+5.0" does not coincide with the type of template block indicated by the latest block number "B3−2.5", the difference in serial number between the searched block number "A1+5.0" and the latest block number "B3−2.5" is not one, and the difference between the sampling rate indicated by the searched block number "A1+5.0" and the sampling rate indicated by the latest block number "B3−2.5" is not 2.5% or less. Therefore, the game system 10 does not increment the count value of the block number counter by one (i.e., count value=1) (step S52).

The game system 10 then searches a block number stored within a range of 9 (=d=8+1) frames around the position that precedes the storage position of the latest block number "B3−2.5" by 60 frames (step S53). Specifically, when a block number that satisfies the conditions has not been found as a result of searching a block number at positions of the block number buffer where the block number selected at the preceding selection timing is considered to be stored, the game system 10 searches a block number at positions of the block number buffer where the block number selected at the last but one selection timing is considered to be stored. That is, the game system 10 searches a block number stored within a range from the position −8 that precedes the position 61 (where the latest block number "B3−2.5" is stored) by 69 frames to the position 10 that precedes the position 61 by 51 frames.

Figure 11:
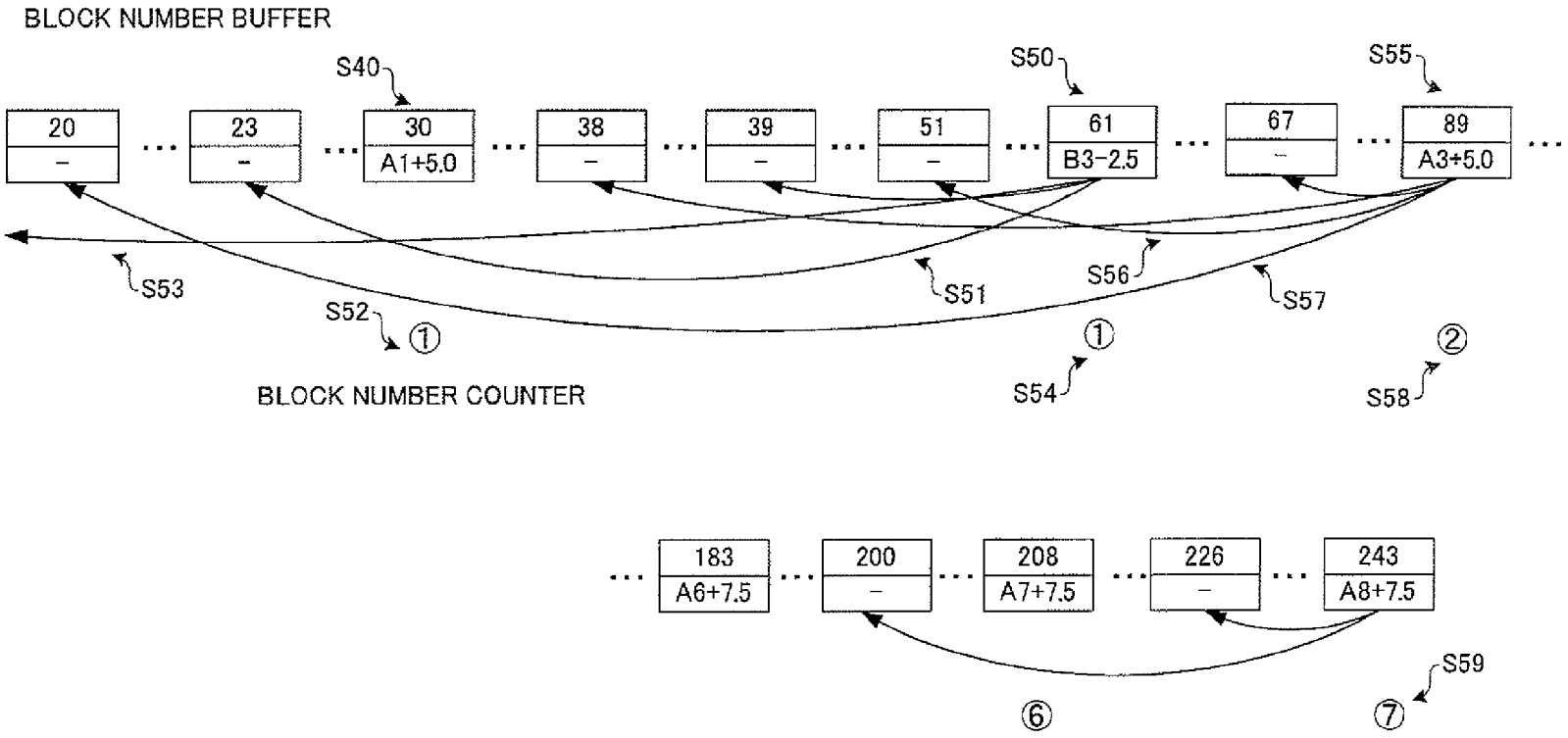
FIG. 11 illustrates a method employed for a game system according to one embodiment of the invention.

In the example in FIG. 11, a block number that satisfies the conditions is not found as a result of searching a block number at positions of the block number buffer where the block number selected at the last but one selection timing is considered to be stored, based on the position 61 where the latest block number "B3−2.5" is stored. In this case, the game system 10 does not increment the count value of the block number counter by one (i.e., count value=1) (step S54).

When the block number "A3+5.0" has been stored at the position 89 of the block number buffer (step S55), the game system 10 searches a block number stored within a range of 8 (=d=5+3) frames around the position that precedes the storage position of the latest block number "A3+5.0" by 30 frames (step S56). Specifically, the game system 10 searches a block number stored within a range from the position 51 that precedes the position 89 (where the latest block number "A3+5.0" is stored) by 38 frames to the position 67 that precedes the position 89 by 22 frames. In the example in FIG. 11, the game system 10 finds the block number "B3−2.5" stored at the position 61.

The game system 10 compares the searched block number "B3−2.5" with the latest block number "A3+5.0", and determines whether or not the type of template block indicated by the searched block number "B3−2.5" coincides with the type of template block indicated by the latest block number "A3+5.0", the difference in serial number between the searched block number "B3−2.5" and the latest block number "A3+5.0" is one, and the difference between the sampling rate indicated by the searched block number "B3−2.5" and the sampling rate indicated by the latest block number "A3+5.0" is 2.5% or less. In the example in FIG. 11, the type of template block indicated by the searched block number "133+2.5" does not coincide with the type of template block indicated by the latest block number "A3+5.0", the difference in serial number between the searched block number "B3+2.5" and the latest block number "A3+5.0" is not one, and the difference between the sampling rate indicated by the searched block number "B3+2.5" and the sampling rate indicated by the latest block number "A3+5.0" is not 2.5% or less. Therefore, the game system 10 does not increment the count value of the block number counter by one (i.e., count value=1) (step S54).

The game system 10 then searches a block number stored within a range of 9 (=d=8+1) frames around the position that precedes the storage position of the latest block number "A3+5.0" by 60 frames (step S57). Specifically, the game system 10 searches a block number stored within a range from the position 20 that precedes the position 89 (where the latest block number "A3+5.0" is stored) by 69 frames to the position 38 that precedes the position 89 by 51 frames. In the example in FIG. 11, the game system 10 finds the block number "A1+5.0" stored at the position 30.

The game system 10 compares the searched block number "A1+5.0" with the latest block number "A3+5.0", and determines whether or not the type of template block indicated by the searched block number "A1+5.0" coincides with the type of template block indicated by the latest block number "A3+5.0", the difference in serial number between the searched block number "A1+5.0" and the latest block number "A3+5.0" is two, and the difference between the sampling rate indicated by the searched block number "A1+5.0" and the sampling rate indicated by the latest block number "A3+5.0" is 2.5% or less. When the searched block number "A1+5.0" and the latest block number "A3+5.0" satisfy the above conditions, the game system 10 determines the range (rmax to rmin) of the reproduction rate of the electronic sound that may be actually output from the first toy 42. In the example in FIG. 11, the type of template block indicated by the searched block number "A1+5.0" coincides with the type of template block indicated by the latest block number "A3+5.0", the difference in serial number between the searched block number "A1+5.0" and the latest block number "A3+5.0" is two, the difference in sampling rate between the searched block number "A1+5.0" and the latest block number "A3+5.0" is 2.5% or less, and the sampling rate R indicated by the latest block number "A3+5.0" is 105.0%. Therefore, the game system 10 determines that rmax=107.5% and rmin=102.5%.

The game system 10 then calculates the interval Dmax at which the block number is stored in the block number buffer when waveform data for which the reproduction rate is rmax has been detected, and the interval Dmin at which the block number is stored in the block number buffer when waveform data for which the reproduction rate is rmin has been detected. In the example in FIG. 11, the sampling rate R indicated by the latest block number "A3+5.0" is 105.0%, the serial number N indicated by the latest block number "A3+5.0" is 3, the sampling rate R' indicated by the searched block number "A1+5.0" is 105.0%, and the serial number N' indicated by the searched block number "A1+5.0" is 1. Therefore, Dmax is (30/107.5)(105.0·3−105.0·1)=58.60, and Dmin is (30/102.5)(105.0·3−105.0·1)=61.46.

The game system 10 then determines whether or not the actual interval between the searched block number "A1+5.0" and the latest block number "A3+5.0" in the block number buffer is included within the range from Dmax to Dmin. In the example in FIG. 11, since the actual interval between the searched block number "A1+5.0" and the latest block number "A3+5.0" in the block number buffer is 59 (=89−30) frames, the actual interval between the searched block number "A1+5.0" and the latest block number "A3+5.0" is included within the range from Dmax to Dmin (Dmax=58.60 to Dmin=61.46).

Therefore, the game system 10 determines that the template block having the searched block number "A1+5.0" and the template block having the latest block number "A3+5.0" correspond to part of the waveform data A reproduced at a reproduction rate around +5.0%, and increments the count value of the block number counter by one (i.e., count value=2) (step S58). When the template blocks having the other block numbers satisfy the above conditions, the count value of the block number counter becomes "7" (step S59).

When the count value of the block number has reached "7" (step S59), the game system 10 determines that seven template blocks corresponding to the waveform data A are stored in ascending order. In the example in FIG. 11, even if some of the block numbers corresponding to the waveform data A cannot be counted, the game system 10 can determine that the waveform data In of the external sound is the waveform data A when the relationship between a plurality of other block numbers satisfies the above conditions. Specifically, when six template blocks (75%) (i.e., predetermined ratio) among eight template blocks corresponding to the waveform data A satisfy the above conditions, the game system 10 determines that the waveform data In of the external sound is the waveform data A.

In this embodiment, when five template blocks among six template blocks corresponding to the waveform data B satisfy the above conditions, the game system 10 determines that the waveform data In of the external sound is the waveform data B. When eleven template blocks among twenty-two template blocks corresponding to the waveform data C satisfy the above conditions, the game system 10 determines that the waveform data In of the external sound is the waveform data C. When eight template blocks among fourteen template blocks corresponding to the waveform data D satisfy the above conditions, the game system 10 determines that the waveform data In of the external sound is the waveform data D. Specifically, the threshold value of the block number counter for specifying the type of electronic sound differs depending on the type of electronic sound indicated by the block number stored in the block number buffer.

3. FUNCTIONAL BLOCKS

Figure 12:
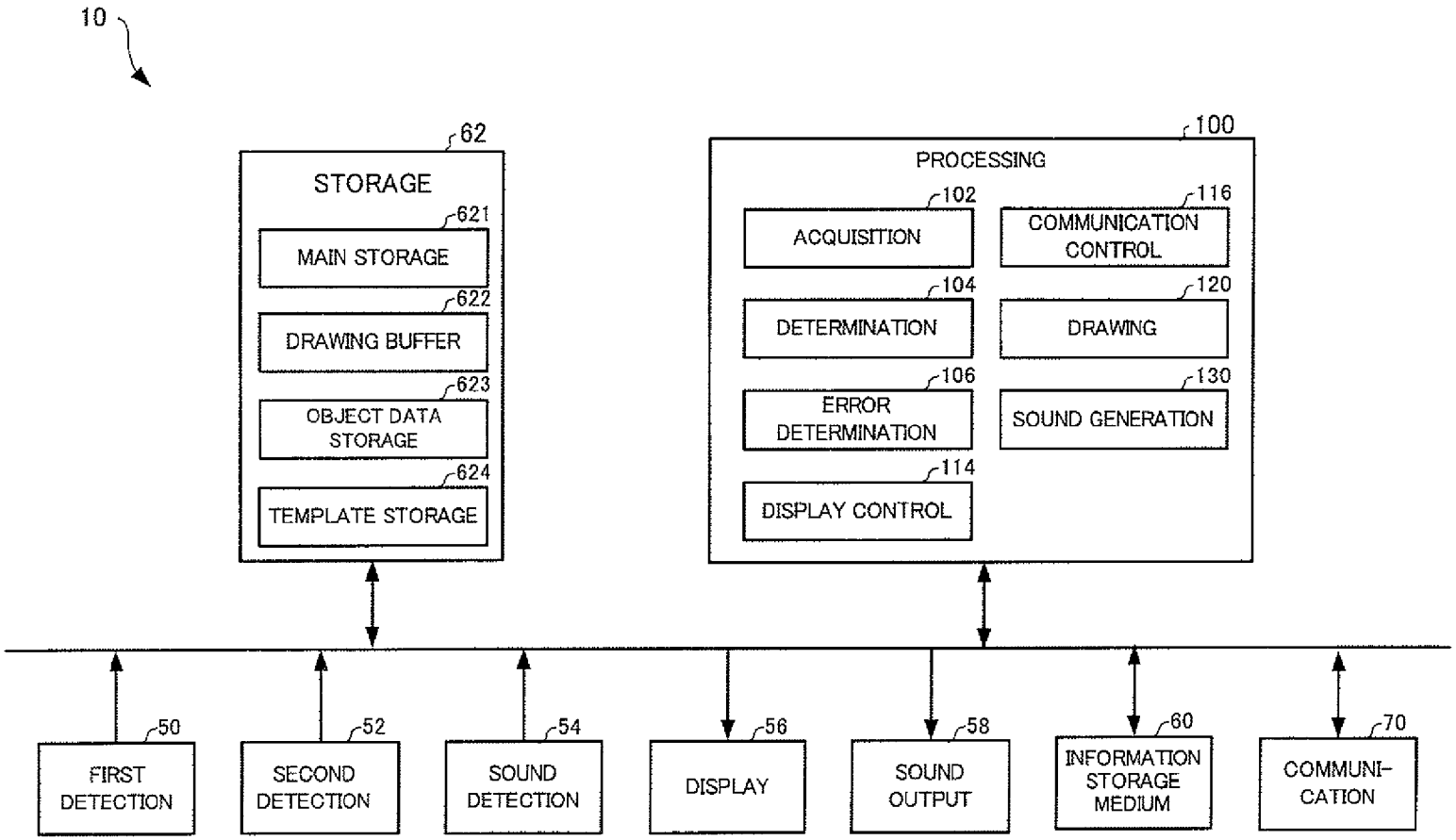
FIG. 12 is a functional block diagram illustrating a game system according to one embodiment of the invention.

FIG. 12 is an example of a functional block diagram of the game system 10 according to this embodiment. Note that the game system 10 according to this embodiment may have a configuration in which some of the elements (sections) illustrated in FIG. 12 are omitted.

A first detection section 50 detects an operation performed using the arrow key 20, the first to fourth buttons 22 to 28, the start button 30, or the select button 32. The function of the first detection section 50 may be implemented by a switch, a pressure sensor, or the like.

A second detection section 52 detects whether or not a touch operation has been performed on the operation surface 39, or detects the touch position of a touch operation performed on the operation surface 39. The function of the second detection section 52 may be implemented by a four-wire or five-wire analog resistive touch panel or the like.

A sound detection section 54 detects an electronic sound output from the first toy 42, the second toy 44, the third toy 46, or the fourth toy 48, and an external sound (e.g., player's voice or clapping). The function of the sound detection section 54 may be implemented by the microphone 38 or the like.

A display section 56 outputs an image generated by the game system 10. The function of the display section 56 may be implemented by a CRT display, a liquid crystal display, a plasma display, a projector, or the like.

A sound output section 58 outputs sound generated by the game system 10. The function of the sound output section 58 may be implemented by the speaker 36, a headphone, or the like.

An information storage medium 60 (computer-readable medium) stores a program for a processing section 100 to perform various processes, data, and the like. The function of the information storage medium 60 may be implemented by a memory card, an optical disk (CD or DVD), a magneto-optical disk (MO), a magnetic disk, a hard disk, a magnetic tape, or the like.

A storage section 62 functions as a work area for the processing section 100, a communication section 70, and the like. The function of the storage section 62 may be implemented by a RAM, a VRAM, or the like. The storage section 62 according to this embodiment includes a main storage section 621 that is used as a work area for the processing section 100, a drawing buffer 622 in which an image displayed on the display section 56 is drawn, an object data storage section 623 that stores data about an object (display object) displayed as an image, and a template storage section 624 that stores a plurality of templates that respectively indicate a plurality of electronic sounds.

The template storage section 624 stores a plurality of templates that differ in reproduction rate and respectively correspond to a plurality of electronic sounds reproduced at different reproduction rates. Specifically, the template storage section 624 stores a plurality of template blocks respectively corresponding to a plurality of electronic sound fragments that differ in start timing and correspond to the first period as the plurality of templates. The plurality of template blocks respectively correspond to a plurality of electronic sound fragments that start at intervals of the first period.

For example, the template blocks of the blocks A1+10 to A8+10 when the reproduction rate of the electronic sound output from the first toy 42 is +10% with respect to the original sound correspond to eight electronic sound fragments corresponding to 0.5 seconds (i.e., first period) (i.e., an electronic sound fragment corresponding to 0.5 seconds that starts at the start timing of the electronic sound output from the first toy 42 reproduced at a reproduction rate of +10% to an electronic sound fragment corresponding to 0.5 seconds that starts when 3.5 seconds has elapsed after the start timing of the electronic sound output from the first toy 42) (see FIG. 7). Specifically, the interval between the start timings of the electronic sound fragments corresponding to the template blocks of the blocks A1+10 to A8+10 is 0.5 seconds (i.e., first period), so that no gap occurs between the end timing and the start timing of adjacent template blocks.

The template blocks of the blocks A1−10 to A8−10 when the reproduction rate of the electronic sound output from the first toy 42 is −10% with respect to the original sound correspond to eight electronic sound fragments corresponding to 0.5 seconds (i.e., first period) (i.e., an electronic sound fragment corresponding to 0.5 seconds that starts at the start timing of the electronic sound output from the first toy 42 reproduced at a reproduction rate of −10% to an electronic sound fragment corresponding to 0.5 seconds that starts when 3.5 seconds has elapsed after the start timing of the electronic sound output from the first toy 42). Specifically, the interval between the start timings of the electronic sound fragments corresponding to the template blocks of the blocks A1−10 to A8−10 is 0.5 seconds (i.e., first period), so that no gap occurs between the end timing and the start timing of adjacent template blocks.

The communication section 70 performs a control process that enables communication with the outside (e.g., server or another portable terminal). The function of the communication section 70 may be implemented by hardware such as a processor or a communication integrated circuit (ASIC), a program, or the like.

A program (data) that causes a computer to function as each section according to this embodiment may be distributed to the information storage medium 60 (storage section 62) from an information storage medium included in a host device (server) through a network and the communication section 70. Use of the information storage medium included in the host device (server) is also included within the scope of the invention.

The processing section 100 (processor) performs a game process, an image generation process, a sound generation process, and the like based on information detected by the first detection section 50, the second detection section 52, the sound detection section 54, and the like, information received by the communication section 70, a program, data, and the like. The processing section 100 performs various processes using the storage section 62 as a work area. The function of the processing section 100 may be implemented by hardware such as a processor (e.g., CPU or DSP) or an integrated circuit (IC) (e.g., ASIC), or a program.

The processing section 100 according to this embodiment includes an acquisition section 102, a determination section 104, an error determination section 106, a display control section 114, a communication control section 116, a drawing section 120, and a sound generation section 130. Note that the processing section 100 may have a configuration in which some of these sections are omitted.

The acquisition section 102 acquires external sound data that indicates an external sound detected by the sound detection section 54. Specifically, the acquisition section 102 acquires an external sound data block every second period, the external sound data block corresponding to an external sound corresponding to the first period. Specifically, the acquisition section 102 performs a DFT process on the waveform data of an external sound corresponding to 1/60th of a second (i.e., second period) every 1/60th of a second (i.e., second period), and stores the external sound data elements of the block element in the external sound data buffer every 1/60th of a second (see FIG. 3). The acquisition section 102 acquires the external sound data elements of thirty block elements corresponding to 30/60th of a second (0.5 seconds) as one external sound data block every 1/60th of a second.

The determination section 104 compares the external sound data with each of the plurality of templates, and determines the type of electronic sound corresponding to the external sound. Specifically, the determination section 104 compares the external sound data block with each of the plurality of template blocks each time the external sound data block is acquired (see FIG. 4). More specifically, the determination section 104 performs a process that selects a template block that satisfies the first condition (i.e., the number of identical values with the external sound data block is a maximum and exceeds the threshold value (10)) (see FIG. 4), a process that determines whether or not the second condition (i.e., the interval between the acquisition timings in the block number buffer is 30±d frames) is satisfied when a template block that satisfies the first condition has been selected with respect to the external sound data block acquired at a different acquisition timing (see FIG. 10), and a process that determines the type of electronic sound corresponding to the external sound based on the type of electronic sound corresponding to the selected template block when the second condition has been satisfied.

The determination section 104 performs a process that determines whether or not the third condition (i.e., the difference in serial number between the electronic sound fragments corresponding to the selected template blocks is 1) is satisfied when a template block that satisfies the first condition has been selected with respect to the external sound data block acquired at a different acquisition timing (see FIG. 10), and a process that determines the type of electronic sound corresponding to the external sound based on the type of electronic sound corresponding to the selected template block when the third condition has been satisfied.

The determination section 104 performs a process that determines whether or not the fourth condition (i.e., the difference in reproduction rate between the electronic sound fragments corresponding to the selected template blocks is 2.5% or less) is satisfied when a template block that satisfies the first condition has been selected with respect to the external sound data block acquired at a different acquisition timing (see FIG. 10), and a process that determines the type of electronic sound corresponding to the external sound based on the type of electronic sound corresponding to the selected template block when the fourth condition has been satisfied.

The error determination section 106 determines an error that has occurred based on the external sound detection state of the sound detection section 54 when the type of electronic sound corresponding to the external sound has not been determined. Specifically, the error determination section 106 determines an error image to be displayed on the display section 56 based on the volume of the external sound detected after a sound input mode has started, when the type of electronic sound corresponding to the external sound has not been determined when 30 seconds has elapsed after the sound input mode has started.

The display control section 114 controls an image (object image) displayed on the display section 56 based on information detected by the first detection section 50, the second detection section 52, the sound detection section 54, and the like, information received by the communication section 70, a program, and the like. Specifically, the display control section 114 generates a display target object (e.g. character, moving object, course, building, tree, pillar, wall, map, or background), instructs display and the display position of the object, or causes the object to disappear, for example. More specifically, the display control section 114 registers a generated object in an object list, transfers the object list to the drawing section 120 or the like, or deletes an object that has disappeared from the object list, for example. The display control section 114 performs a movement process that moves the object, and a motion process that causes the object to make a motion.

The display control section 114 performs the movement process that moves the object in an object space (movement simulation) based on information detected by the first detection section 50, the second detection section 52, the sound detection section 54, and the like, information received by the communication section 70, a program (movement algorithm), data (movement data), and the like. Specifically, the display control section 114 performs a simulation process that sequentially calculates object movement information (position, rotational angle, speed, or acceleration) every frame (1/60th of a second). The term "frame" refers to a time unit used when performing the object movement process or the image generation process.

The display control section 114 performs the motion process that causes the object to make a motion (animation) in the object space (motion simulation) based on information detected by the first detection section 50, the second detection section 52, the sound detection section 54, and the like, information received by the communication section 70, a program (motion algorithm), data (motion data), and the like. Specifically, the display control section 114 performs a simulation process that sequentially calculates object motion information (position or rotational angle of each part that forms the object) every frame (1/60th of a second).

The display control section 114 functions as an execution section, and displays the object based on the type of the electronic sound determined. Specifically, when the external sound detected by the microphone 38 has been determined to be the electronic sound output from one of the toys, the display control section 114 changes the image displayed on the first display screen 17 or the second display screen 33 based on the type of the electronic sound determined. For example, the display control section 114 generates a character corresponding to the type of the electronic sound determined, moves the generated character, or causes the generated character to make a motion, change in shape, or disappear. The display control section 114 causes the character to make a motion corresponding to the type of the electronic sound determined.

The display control section 114 displays the error image on the display section 56 based on the determination result of the error determination section 106. Specifically, the display control section 114 displays one of the error images illustrated in FIGS. 2A to 2C that corresponds to the type of error specified by the error determination section 106 on the first display screen 17 or the second display screen 33.

The communication control section 116 generates a packet transmitted to another game system 10, designates the network address of the packet transmission destination game system 10, stores a received packet in the storage section 62, analyzes the received packet, and controls the communication section 70 relating to packet transmission and reception, for example. The communication control section 116 generates a data packet and a command packet necessary for executing the game via a network (e.g., Internet), and causes the communication section 70 to transmit and receive the data packet and the command packet.

The drawing section 120 performs a drawing process based on the results of various processes (game process) performed by the processing section 100 to generate an image, and outputs the generated image to the display section 56.

The sound generation section 130 performs a sound generation process based on the results of various processes performed by the processing section 100 to generate game sound such as background music (BGM), effect sound, or voice, and outputs the generated game sound to the sound output section 58.

The image generation system according to this embodiment may be a system dedicated to a single-player mode that allows only one player to play the game, or may be a system that is provided with a multi-player mode that allows a plurality of players to play the game. When a plurality of players play the game, a game image and game sound supplied to each player may be generated using one terminal, or may be generated by a distributed process using a plurality of terminals (game devices or portable telephones) connected via a network (transmission line or communication line), for example.

4. PROCESS ACCORDING TO THIS EMBODIMENT

The flow of the process performed by the game system 10 according to this embodiment is described below.

Figure 13:
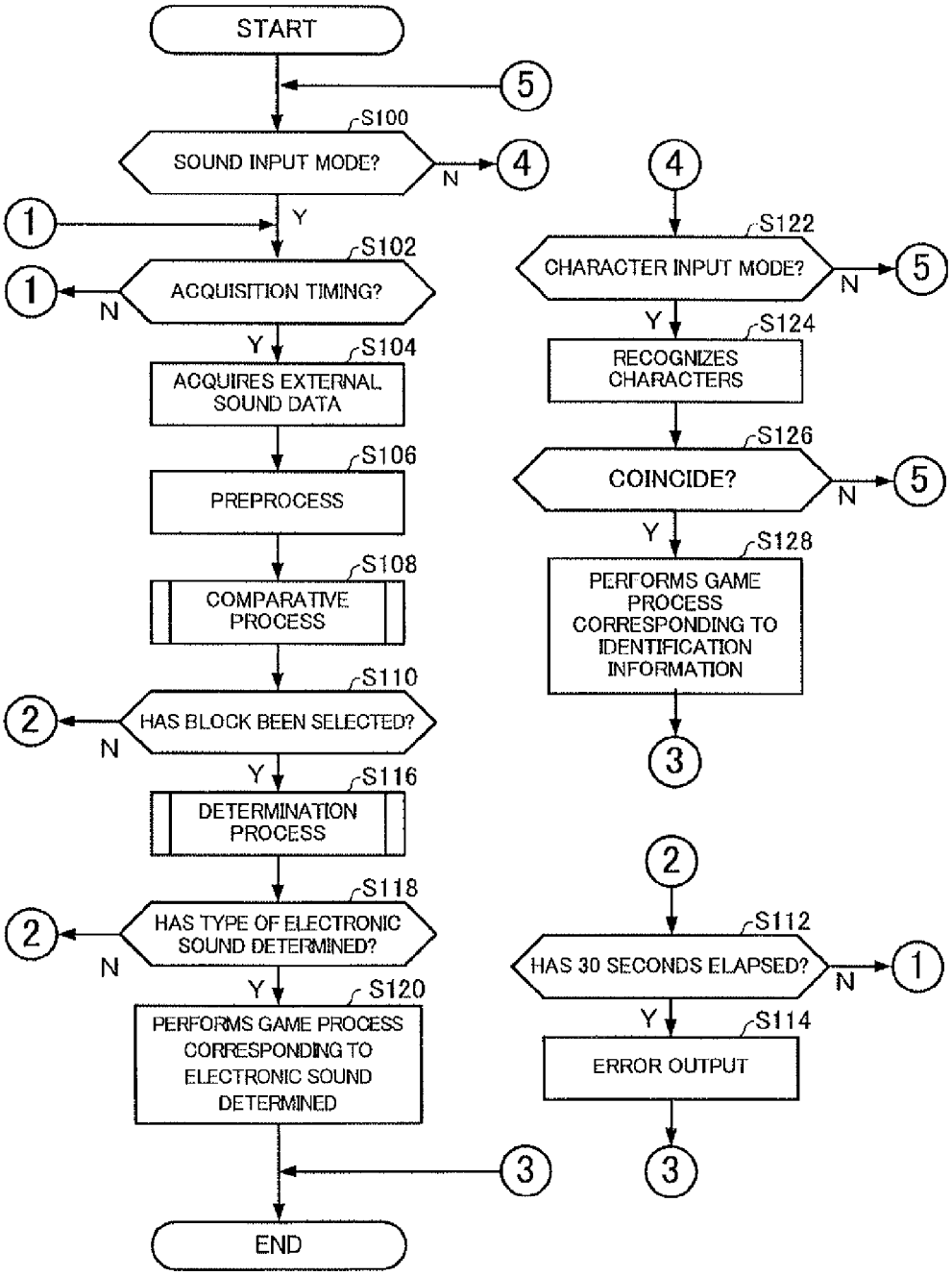
FIG. 13 is a flowchart illustrating the flow of a process performed by a game system according to one embodiment of the invention.

FIG. 13 is a flowchart schematically illustrating the flow of the process performed by the game system 10 according to this embodiment. As illustrated in FIG. 13, when the sound input mode has occurred based on a selection operation performed by the player (Y in step S100), the game system 10 determines whether or not the acquisition timing (every 1/60th of a second) at which the external sound data is acquired based on the external sound detected by the microphone 38 has been reached (step S102). When the acquisition timing has been reached (Y in step S102), the game system 10 acquires the external sound data corresponding to 1/60th of a second (step S104). The game system 10 reduces the sampling rate of the acquired external sound data by about 2/3, and removes noise in a low-frequency region (preprocess) (step S106). The game system 10 compares the external sound data block with each template block, and selects a template block that satisfies the first condition (comparative process) (step S108). When a template block that satisfies the first condition has not been selected by the comparative process (N in step S110), the game system 10 determines whether or not 30 seconds has elapsed after the sound input mode has occurred (step S112). When 30 seconds has elapsed after the sound input mode has occurred (Y in step S112), the game system 10 displays an error image on the display section 56 based on the volume of the external sound data acquired within 30 seconds after the sound input mode has occurred (step S114). When 30 seconds has not elapsed after the sound input mode has occurred (N in step S112), the game system 10 returns to the step S102.

When a template block that satisfies the first condition has been selected by the comparative process (Y in step S110), the game system 10 determines the type of electronic sound corresponding to the external sound based on the block number of the selected template block and the block number of the template block selected for the external sound data block acquired at another acquisition timing (determination process) (step S116). When the type of electronic sound corresponding to the external sound has not been determined by the determination process (N in step S118), the game system 10 returns to the step S102. When the type of electronic sound corresponding to the external sound has been determined by the determination process (Y in step S118), the game system 10 displays a character corresponding to the type of the electronic sound determined on the display section 56 (step S120).

When a character input mode has occurred based on a selection operation performed by the player (Y in step S122), the game system 10 receives a character input operation performed on the first display screen 17 using the touch pen 41, and recognizes the characters drawn on the first display screen 17 (step S124). In this embodiment, identification information corresponding to each toy is provided for each toy. When the game system 10 has determined that characters corresponding to the identification information have been drawn on the first display screen 17 (Y in step S126), the game system 10 displays a character corresponding to the toy that corresponds to the identification information on the display section 56 (step S128). This makes it possible to display a character corresponding to the toy possessed by the player on the display section even if the toy cannot output the electronic sound (e.g., battery is dead), or the game system 10 cannot determine the electronic sound.

Figure 14:
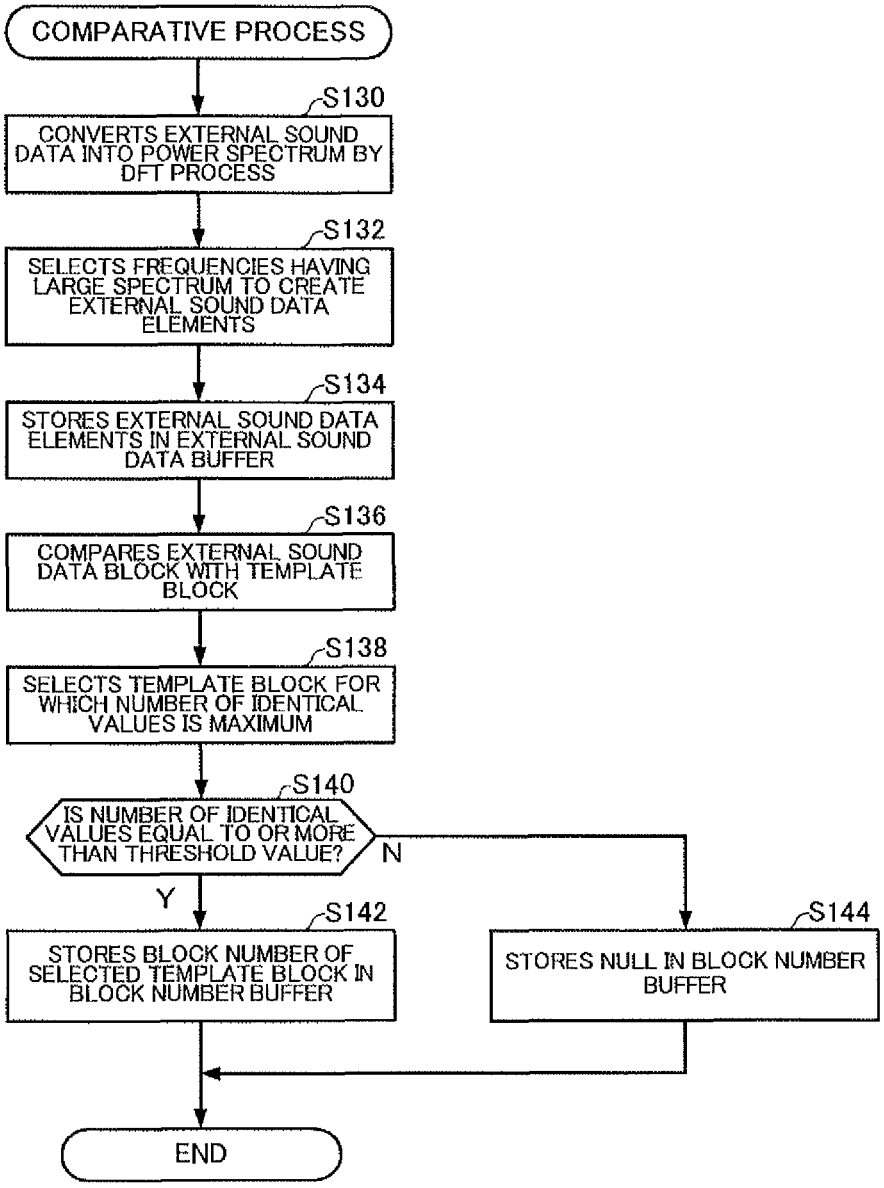
FIG. 14 is a flowchart illustrating the flow of a process performed by a game system according to one embodiment of the invention.

FIG. 14 is a flowchart illustrating the details of the flow of the comparative process performed by the game system 10 in the step S108 in FIG. 13. As illustrated in FIG. 14, the game system 10 converts the external sound data corresponding to 1/60th of a second into a power spectrum by performing a DFT process (step S130), selects frequencies having a large spectrum to create external sound data elements (step S132), and stores the external sound data elements in the external sound data buffer (step S134). The game system 10 compares the external sound data block (i.e., external sound data elements corresponding to 30/60th of a second (0.5 seconds)) with each of the 450 template blocks, and counts the number of identical values (step S136). The game system 10 selects the template block for which the number of identical values is a maximum (step S138). When the number of identical values is equal to or more than the threshold value (e.g., 10) (Y in step S140), the game system 10 stores the block number of the selected template block in the block number buffer (step S142). When the number of identical values is less than the threshold value (e.g., 10) (N in step S140), the game system 10 stores NULL in the block number buffer (step S144).

Figure 15:
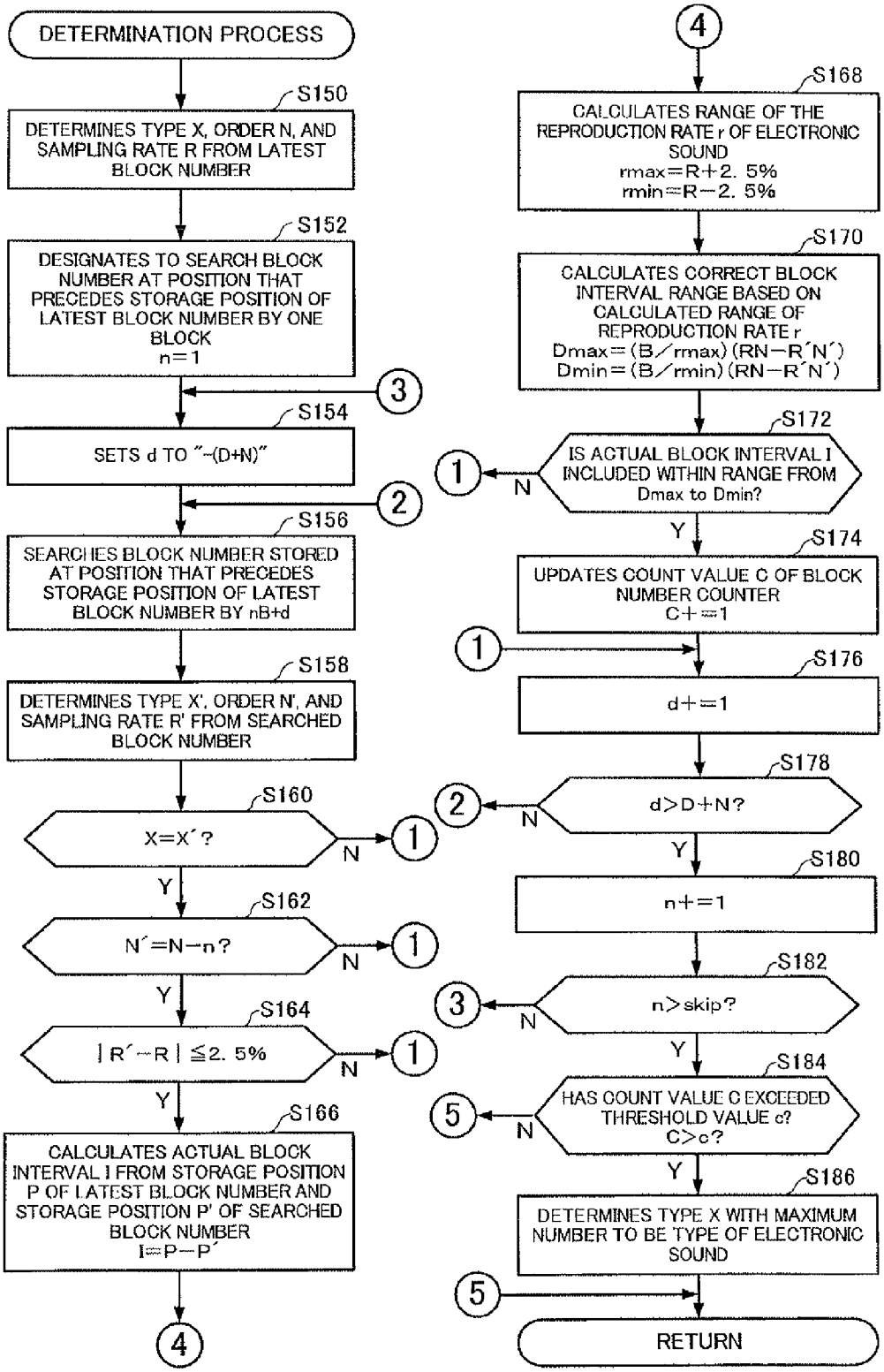
FIG. 15 is a flowchart illustrating the flow of a process performed by a game system according to one embodiment of the invention.

FIG. 15 is a flowchart illustrating the details of the flow of the determination process performed by the game system 10 in the step S116 in FIG. 13. As illustrated in FIG. 15, the game system 10 determines the type X (e.g., A) of electronic sound that corresponds to the template block indicated by the latest block number stored in the block number buffer, the serial number N (e.g., 2) of the template block indicated by the latest block number, and the sampling rate R (e.g., 102.5) of the template block indicated by the latest block number (step S150). The game system 10 substitutes "1" for the position n of the block number buffer at which a block number is searched (i.e., designates to search a block number at a position that precedes the storage position of the latest block number by one block (30 frames)) (step S152). The game system 10 sets the constant D defined taking account of an error by several frames that occurs due to surrounding noise, a DFT process, and the like to "5", and sets d for designating the block number search range to "−(D+N)" (step S154). The game system 10 sets the interval B in the ideal state to "30", and searches a block number stored at a position that precedes the storage position of the latest block number by nB+d (step S156).

When the game system 10 has found a block number, the game system 10 determines the type X' (e.g., A) of electronic sound that corresponds to the template block indicated by the searched block number, the serial number N' (e.g., 1) of the template block indicated by the searched block number, and the sampling rate R' (e.g., 105.0) of the template block indicated by the searched block number (step S158). When the type X of electronic sound that corresponds to the template block indicated by the latest block number coincides with the type X' of electronic sound that corresponds to the template block indicated by the searched block number (Y in step S160), the difference between the serial number N of the template block indicated by the latest block number and the serial number N' of the template block indicated by the searched block number is n (Y in step S162), and the absolute value of the difference between the sampling rate R of the template block indicated by the latest block number and the sampling rate R' of the template block indicated by the searched block number is 2.5% or less (Y in step S164), the game system 10 calculates the actual block interval I from the storage position P of the latest block number and the storage position P' of the searched block number in the block number buffer (step S166).

The game system 10 calculates the range (rmax to rmin) of the reproduction rate r of the electronic sound that may be actually output from the toy based on the sampling rate R indicated by the latest block number (rmax=R+2.5%, rmin=R−2.5%) (step S168). The game system 10 calculates the correct block interval range (i.e., the interval between the position of the latest block number when the electronic sound is output within the calculated range of the reproduction rate r and the position of the searched block number (Dmax=(B/rmax)(RN−R'N'), Dmin=(B/rmin)(RN−R'N')) (step S170). The game system 10 determines whether or not the actual block interval I is included within the range from Dmax to Dmin (step S172).

When the actual block interval I is included within the range from Dmax to Dmin (Y in step S172), the game system 10 updates the count value C of the block number counter (step S174). The game system 10 thus increments d by one (step S176). When d is larger than D+N (Y in step S178), the game system 10 increments n by one (i.e., designates to search a block number at a position that precedes the storage position of the latest block number by more than one block (30 frames)) (step S180). When a search block threshold value skip is larger than n (Y in step S182), the game system 10 determines whether or not the count value C of the block number counter has exceeded a threshold value c (step S184). When the count value C of the block number counter has exceeded the threshold value c (Y in step S184), the game system 10 determines the type X with a maximum number among the types X of template blocks indicated by the block numbers stored in the block number buffer to be the type of the electronic sound detected by the microphone 38 (step S186), and finishes the determination process. When the count value C of the block number counter has not exceeded the threshold value c (N in step S184), the game system 10 finishes the determination process without determining the type of the electronic sound detected by the microphone 38.

In this embodiment, the value skip used in the step S182 is set to "2" (a block number is searched at a position that precedes the storage position of the latest block number by two blocks). Therefore, since n is not larger than the value skip (N in step S182) when n has been incremented by one in the step S180 (i.e., n=2), the game system 10 returns to the step S154. This makes it possible to update the count value C of the block number counter in the step S174 when a block number at a position that precedes the storage position of the latest block number by two blocks satisfies the above conditions, even if the block number corresponding to one block is absent in the block number buffer due to surrounding noise or the like.

When the type X of electronic sound that corresponds to the template block indicated by the latest block number does not coincide with the type X' of electronic sound that corresponds to the template block indicated by the searched block number (N in step S160), or the difference between the serial number N of the template block indicated by the latest block number and the serial number N' of the template block indicated by the searched block number is not n (N in step S162), or the absolute value of the difference between the sampling rate R of the template block indicated by the latest block number and the sampling rate R' of the template block indicated by the searched block number is more than 2.5% (N in step S164), or the actual block interval I is not included within the range from Dmax to Dmin (N in step S172), the game system 10 transitions to the step S176, and increments d by one. When d is equal to or smaller than D+N (N in step S178), the game system 10 returns to the step S156.

5. MODIFICATION

The invention is not limited to the above embodiments. Various modifications and variations may be made. Several modifications are described below. Note that various methods described in connection with the above embodiments and the following modifications may be appropriately combined as a control method that implements the invention.

5-1. First Modification

5-1-1. Template Creation Method

The above embodiments have been described taking an example in which each of the template blocks corresponds to each of the electronic sound fragments that start at intervals of the first period (see FIG. 7). In the above embodiments, when the reproduction rate of the electronic sound is an intermediate value of the reproduction rate determined in advance, a difference in time interval between the external sound data block and the template block increases with the passage of time after the external sound corresponding to the electronic sound has been acquired (see FIG. 9). Therefore, when determining whether or not the interval between the acquisition timings satisfies the second condition when template blocks that satisfy the first condition have been selected for external sound data blocks that have been acquired at different acquisition timings, the processing load increases since it is necessary to take account of an error that increases with the passage of time after the external sound corresponding to the electronic sound has been acquired (see FIGS. 10 and 11). Since the search range in the block number buffer increases, the load imposed by the search process increases.

In the following first modification, a plurality of template blocks respectively correspond to a plurality of electronic sound fragments that start at intervals of a period corresponding to the reproduction rate. This makes it possible to reduce a difference in time interval between the external sound data block and the template block even when the reproduction rate of the electronic sound is an intermediate value of the reproduction rate determined in advance.

Figure 16:
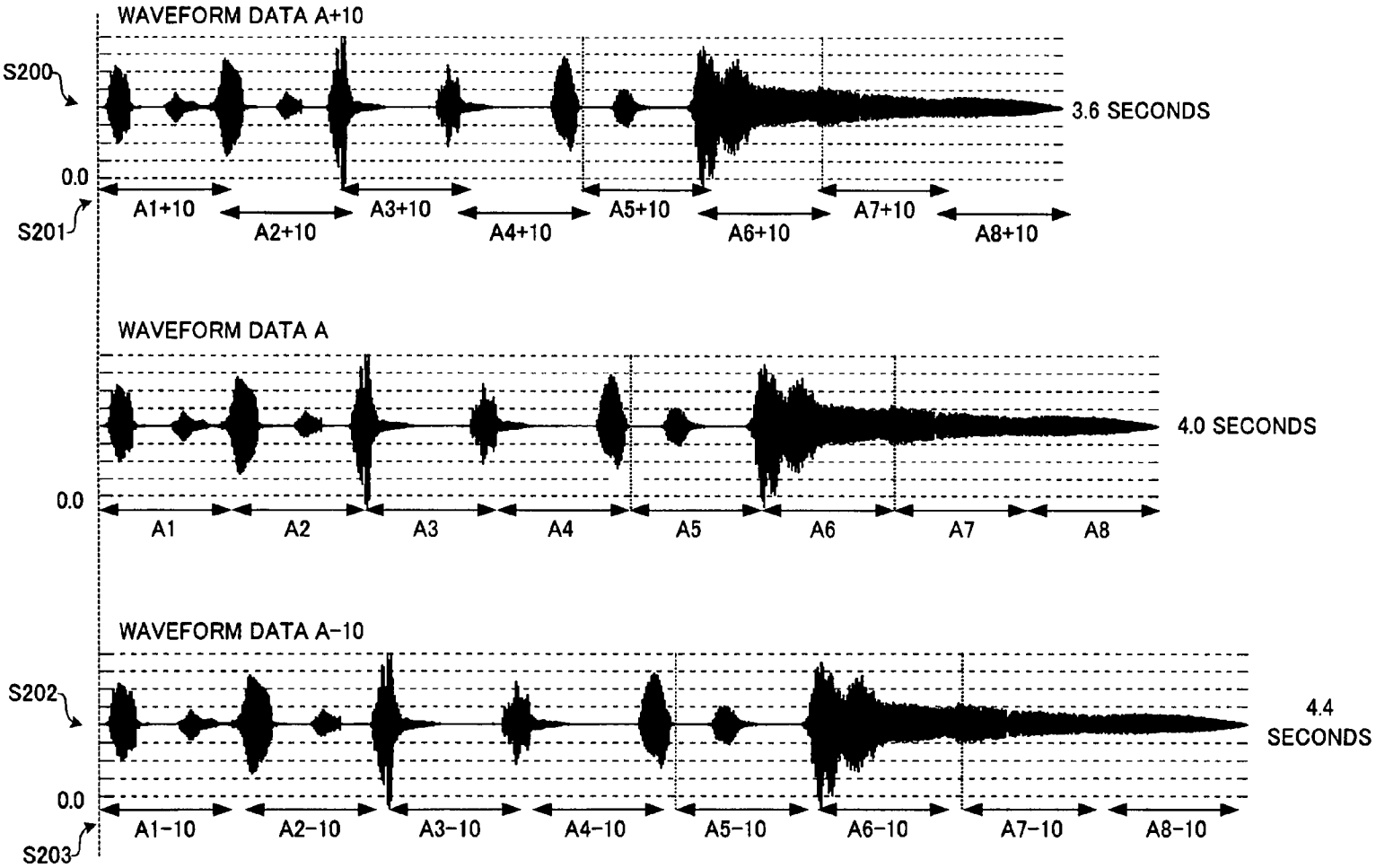
FIG. 16 illustrates a method employed for a game system according to a modification of one embodiment of the invention.

FIG. 16 illustrates a method of creating a plurality of template blocks that respectively correspond to a plurality of electronic sound fragments that start at intervals of a period corresponding to the reproduction rate. FIG. 16 illustrates an example of creating a template corresponding to the electronic sound output from the first toy 42. When creating a template corresponding to the waveform data when the reproduction rate of the electronic sound output from the first toy 42 is +10% with respect to the original sound, the waveform data A+10 is obtained by converting the waveform data A (original sound) so that the sampling rate is +10% (step S200 in FIG. 16). The sampling period of the waveform data A+10 is 3.6 seconds.

The waveform data A+10 (3.6 seconds) is divided into eight blocks so that the sampling period of each block is 0.5 seconds (step S201 in FIG. 16). Specifically, the waveform data A+10 (3.6 seconds) is divided into a first block A1+10 that corresponds to 0.5 seconds from the start of the waveform data A+10, a second block A2+10 that corresponds to 0.5 seconds and starts when 0.45 seconds has elapsed after the start timing of the waveform data A+10, a third block A3+10 that corresponds to 0.5 seconds and starts when 0.9 seconds has elapsed after the start timing of the waveform data A+10, a fourth block A4+10 that corresponds to 0.5 seconds and starts when 1.35 seconds has elapsed after the start timing of the waveform data A+10, a fifth block A5+10 that corresponds to 0.5 seconds and starts when 1.80 seconds has elapsed after the start timing of the waveform data A+10, a sixth block A6+10 that corresponds to 0.5 seconds and starts when 2.25 seconds has elapsed after the start timing of the waveform data A+10, a seventh block A7+10 that corresponds to 0.5 seconds and starts when 2.7 seconds has elapsed after the start timing of the waveform data A+10, and an eighth block A8+10 that corresponds to 0.5 seconds and starts when 3.15 seconds has elapsed after the start timing of the waveform data A+10.

Each of the blocks A1+10 to A8+10 is divided into thirty block elements so that the sampling period of each block element is 1/60th of a second in the same manner as in the case of creating a template corresponding to the waveform data A (step S3 in FIG. 3).

Template elements of each block element are determined from the waveform data of each block element. The template elements of the thirty block elements that belong to the block A1+10 form a template block of the block A1+10. Likewise, the template elements of the thirty block elements that belong to the blocks A2+10 to A8+10 form template blocks of the blocks A2+10 to A8+10, respectively. The template blocks of the blocks A1+10 to A8+10 are thus obtained as a template corresponding to the waveform data A+10. Note that the template elements of the block element of blank data (0.05 seconds) at the end of the eighth block A8+10 are "0".

Specifically, the template blocks of the blocks A1+10 to A8+10 correspond to eight electronic sound fragments corresponding to 0.5 seconds (i.e., first period) (i.e., an electronic sound fragment corresponding to 0.5 seconds that starts at the start timing of the electronic sound output from the first toy 42 reproduced at a reproduction rate of +10% to an electronic sound fragment corresponding to 0.5 seconds that starts when 3.15 seconds has elapsed after the start timing of the electronic sound output from the first toy 42). The interval between the start timings of the electronic sound fragments that respectively correspond to the template blocks of the blocks A1+10 to A8+10 is 0.45 seconds (i.e., a period corresponding to the reproduction rate) that is shorter by 10% than the interval (0.5 seconds) between the start timings of the electronic sound fragments that respectively correspond to the template blocks of the blocks A1 to A8.

Each of the electronic sound fragments that respectively correspond to the template blocks of the blocks A1+10 to A8+10 overlap the adjacent electronic sound fragment for 0.05 seconds that correspond to 10% of the period (0.5 seconds) of each electronic sound fragment.

The interval between the end timings of the electronic sound fragments that respectively correspond to the template blocks of the blocks A1+10 to A8+10 is also 0.45 seconds (i.e., a period corresponding to the reproduction rate). Therefore, when the waveform data A+10 has been acquired, the interval between the selection timings of the template blocks of the blocks A1+10 to A8+10 in the comparative process illustrated in FIG. 4 is 0.45 seconds. Specifically, even when the waveform data at a sampling rate that coincides with the reproduction rate of the template block has been acquired, the interval between the selection timings of the template blocks is not 0.5 seconds. When the waveform data A+10 has been acquired, the interval between the selection timings of the template blocks is shorter than 0.5 seconds by 10%.

When creating a template corresponding to the waveform data when the reproduction rate of the electronic sound output from the first toy 42 is −10% with respect to the original sound, the waveform data A−10 is obtained by converting the waveform data A (original sound) so that the sampling rate is −10% (step S202 in FIG. 16). The sampling period of the waveform data A−10 is 4.4 seconds.

The waveform data A−10 (4.4 seconds) is divided into eight blocks so that the sampling period of each block is 0.5 seconds (step S203). Specifically, the waveform data A−10 (4.4 seconds) is divided into a first block A1−10 that corresponds to 0.5 seconds from the start of the waveform data A−10, a second block A2−10 that corresponds to 0.5 seconds and starts when 0.55 seconds has elapsed after the start timing of the waveform data A−10, a third block A3−10 that corresponds to 0.5 seconds and starts when 1.1 seconds has elapsed after the start timing of the waveform data A−10, a fourth block A4−10 that corresponds to 0.5 seconds and starts when 1.65 seconds has elapsed after the start timing of the waveform data A−10, a fifth block A5−10 that corresponds to 0.5 seconds and starts when 2.2 seconds has elapsed after the start timing of the waveform data A−10, a sixth block A6−10 that corresponds to 0.5 seconds and starts when 2.75 seconds has elapsed after the start timing of the waveform data A−10, a seventh block A7−10 that corresponds to 0.5 seconds and starts when 3.3 seconds has elapsed after the start timing of the waveform data A−10, and an eighth block A8−10 that corresponds to 0.5 seconds and starts when 3.85 seconds has elapsed after the start timing of the waveform data A−10.

Each of the blocks A1−10 to A8−10 is divided into thirty block elements so that the sampling period of each block element is 1/60th of a second in the same manner as in the case of creating a template corresponding to the waveform data A (step S3 in FIG. 3).

Template elements of each block element are determined from the waveform data of each block element. The template elements of the thirty block elements that belong to the block A1−10 form a template block of the block A1−10. Likewise, the template elements of the thirty block elements that belong to the blocks A2−10 to A8−10 form template blocks of the blocks A2−10 to A8−10, respectively. The template blocks of the blocks A1−10 to A8−10 are thus obtained as a template corresponding to the waveform data A−10. Since the sampling period of the waveform data A−10 is 4.4 seconds, a template block is not created for the waveform data corresponding to 0.05 seconds at the end of the waveform data A−10.

Specifically, the template blocks of the blocks A1−10 to A8−10 correspond to eight electronic sound fragments corresponding to 0.5 seconds (i.e., first period) (i.e., an electronic sound fragment corresponding to 0.5 seconds that starts at the start timing of the electronic sound output from the first toy 42 reproduced at a reproduction rate of −10% to an electronic sound fragment corresponding to 0.5 seconds that starts when 3.85 seconds has elapsed after the start timing of the electronic sound output from the first toy 42). The interval between the start timings of the electronic sound fragments that respectively correspond to the template blocks of the blocks A1−10 to A8−10 is 0.55 seconds (i.e., a period corresponding to the reproduction rate) that is longer by 10% than the interval (0.5 seconds) between the start timings of the electronic sound fragments that respectively correspond to the template blocks of the blocks A1 to A8.

Each of the electronic sound fragments that respectively correspond to the template blocks of the blocks A1−10 to A8−10 starts at an interval of 0.05 seconds (corresponding to 10% of the period (0.5 seconds) of each electronic sound fragment) from the adjacent electronic sound fragment.

The interval between the end timings of the electronic sound fragments that respectively correspond to the template blocks of the blocks A1−10 to A8−10 is also 0.55 seconds (i.e., a period corresponding to the reproduction rate). Therefore, when the waveform data A−10 has been acquired, the interval between the selection timings of the template blocks of the blocks A1−10 to A8−10 in the comparative process illustrated in FIG. 4 is 0.55 seconds. Specifically, when the waveform data A−10 has been acquired, the interval between the selection timings of the template blocks is longer than 0.5 seconds by 10%.

450 template blocks (i.e., the template blocks of the blocks A1+10 to D14−10) are created as the template blocks corresponding to the waveform data of the electronic sounds of the first to fourth toys 42 to 48, in the same manner as in the above embodiments.

As illustrated in FIG. 16, the shape of the waveform data of the filth block A5+10 of the waveform data A+10, the shape of the waveform data of the fifth block A5 of the waveform data A, and the shape of the waveform data of the fifth block A5−10 of the waveform data A−10 (i.e., the waveform data of a plurality of blocks that are identical in the type of waveform data and the block number, but differ in sampling rate) differ to only a small extent. Specifically, since the interval between the start timings of the eight blocks is changed based on a change in the sampling rate of the waveform data A, the waveform data corresponding to the start timing is identical between a plurality of blocks having the above relationship. The difference in shape of the waveform data between a plurality of blocks having the above relationship does not increase even if the block number increases (i.e., the block is positioned away from the head of the waveform data).

5-1-2. Comparative Method

In the first modification, even when the waveform data at a sampling rate that coincides with the reproduction rate of the template block has been acquired, the interval between the selection timings of the template blocks is not 0.5 seconds, but is an interval corresponding to the reproduction rate of the acquired waveform data in the comparative process illustrated in FIG. 4. However, a change in the interval between the selection timings of the template blocks corresponding to the reproduction rate is as small as about 0.05 seconds (10% of 0.5 seconds) (i.e., 3 frames in the block number buffer in FIG. 10), even when the waveform data (e.g., waveform data A+10 or A−10) for which a change in reproduction rate is large has been acquired. Therefore, a change in the interval between the selection timings of the template blocks corresponding to the reproduction rate can be absorbed by searching a block number stored within a range of "d=5" frames around the position that precedes the storage position of the latest block number by 30 frames.

In the first modification, waveform data at an intermediate reproduction rate with respect to the sampling rate of the template block (e.g., waveform data for which the reproduction rate of the electronic sound output from the first toy 42 is +6.25% with respect to the original sound) may be acquired in the same manner as in the above embodiments.

Figure 17:
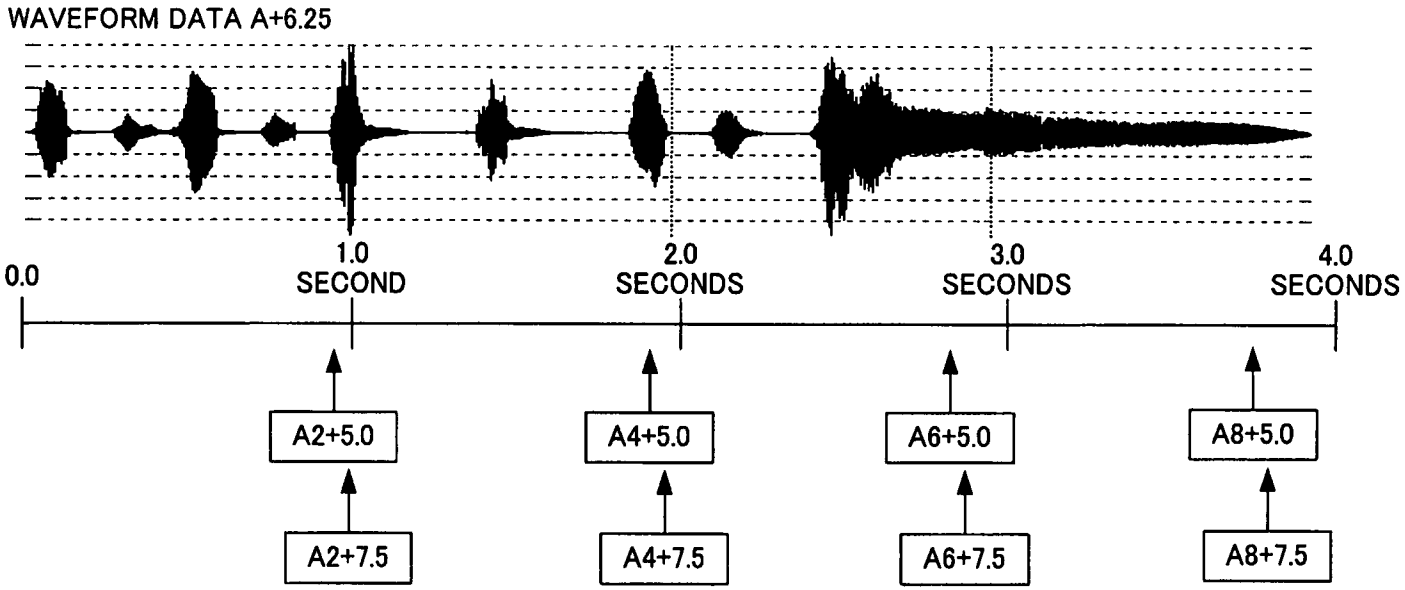
FIG. 17 illustrates a method employed for a game system according to a modification of one embodiment of the invention.

FIG. 17 illustrates the template block selection timing when the waveform data A+6.25 has been acquired when the game system 10 uses the template block according to the first modification. When the waveform data A+6.25 has been acquired, a template block corresponding to the waveform data A+6.25 is selected about every 29/60th of a second when a template block corresponding to the waveform data A+6.25 is provided. However, when a template block corresponding to the waveform data A+6.25 is not provided, and a template block corresponding to the waveform data A+5.0 is selected (FIG. 17), the template block corresponding to the waveform data A+5.0 is selected at an interval shorter than about 29/60th of a second by 1.25% since the sampling rate of the template block corresponding to the waveform data A+5.0 is lower than that of the external sound data block of the waveform data A+6.25 by 1.25%. On the other hand, a template block corresponding to the waveform data A+7.5 is selected at an interval longer than about 29/60th of a second by 1.25% since the sampling rate of the template block corresponding to the waveform data A+7.5 is higher than that of the external sound data block of the waveform data A+6.25 by 1.25%.

Figure 18:
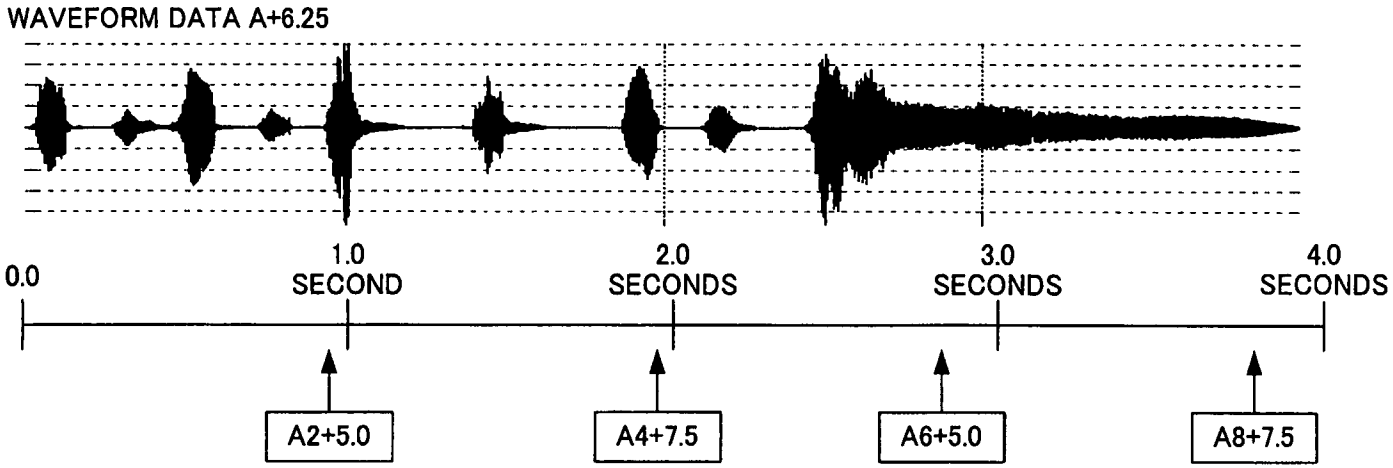
FIG. 18 illustrates a method employed for a game system according to a modification of one embodiment of the invention.

However, when a template block corresponding to the waveform data A+5.0 and a template block corresponding to the waveform data A+7.5 are alternately selected for the waveform data A+6.25 (see FIG. 18), a situation in which the template block is selected at an interval longer than about 29/60th of a second and a situation in which the template block is selected at an interval shorter than about 29/60th of a second occur alternately, but the interval between the selection timings of the template blocks does not deviate from about 29/60 seconds with the passage of time after the waveform data A+6.25 has been acquired, differing from the above embodiments. Specifically, an error of the interval between the selection timings of the template blocks does not change even if the block number increases.

According to the first modification, since it is unnecessary to take account of an error that increases as the block number increases when searching a block number stored at a position that precedes the storage position of the latest block number by 30 frames, it is unnecessary to add the serial number N of the template block indicated by the latest block number to the block number search range. Specifically, the block number search range can be narrowed as compared with the above embodiments, so that the processing load can be reduced.

Figure 19:
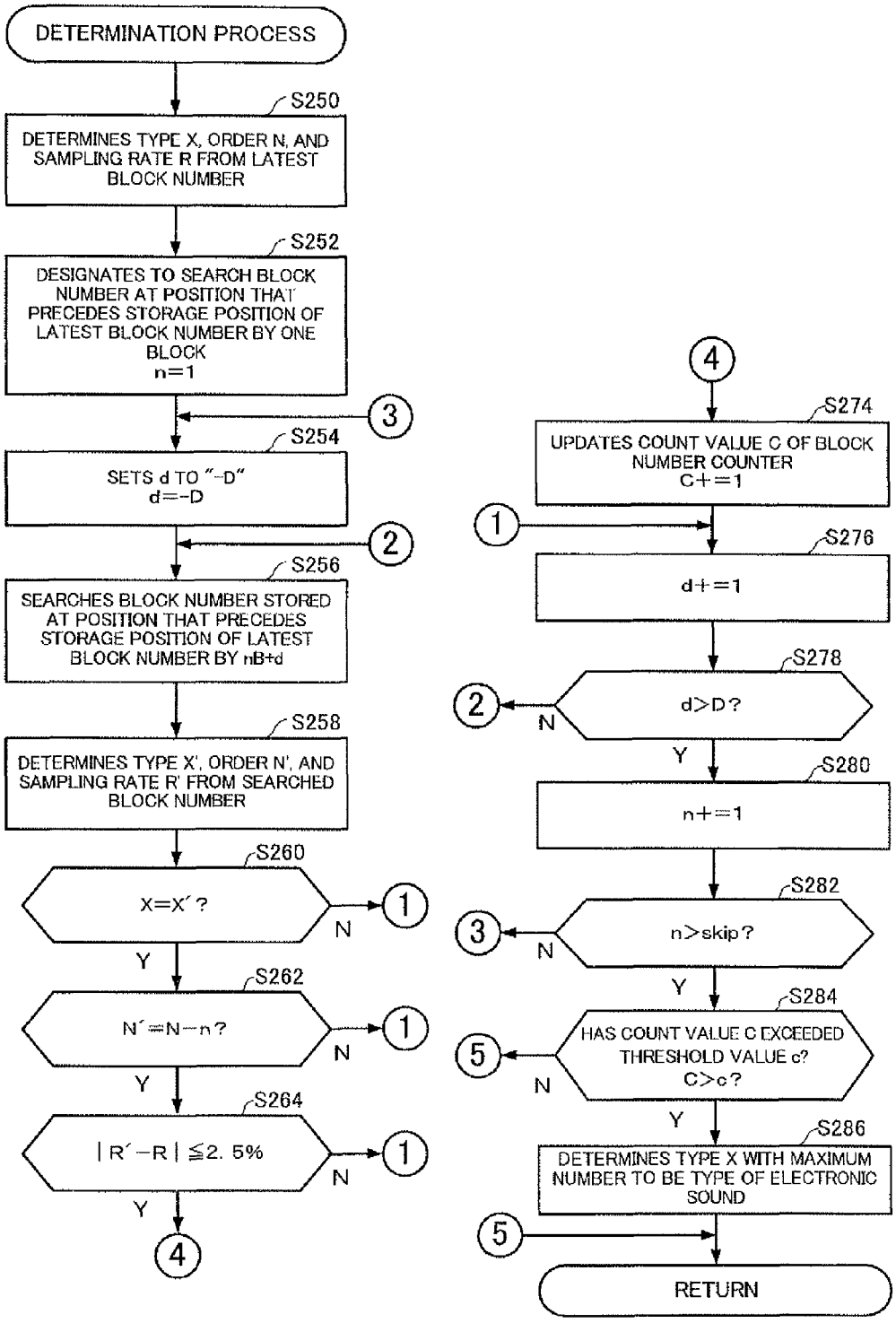
FIG. 19 is a flowchart illustrating the flow of a process performed by a game system according to one embodiment of the invention.

FIG. 19 is a flowchart illustrating the details of the flow of the determination process performed in the step S116 in FIG. 13 when the game system 10 uses the template block according to the first modification. As illustrated in FIG. 19, the game system 10 determines the type X (e.g., A) of electronic sound that corresponds to the template block indicated by the latest block number stored in the block number buffer, the serial number N (e.g., 2) of the template block indicated by the latest block number, and the sampling rate R (e.g., +102.5) of the template block indicated by the latest block number (step S250). The game system 10 substitutes "1" for the position n of the block number buffer at which a block number is searched (i.e., designates to search a block number at a position that precedes the storage position of the latest block number by one block (30 frames) (step S252). The game system 10 sets the constant D defined taking account of a change in the interval between the selection timings of the template blocks corresponding to the reproduction rate, an error by several frames that occurs due to surrounding noise, a DFT process, and the like to "5", and sets d for designating the block number search range to "−D" (step S254). The game system 10 sets the interval B in the ideal state to "30", and searches a block number stored at a position that precedes the storage position of the latest block number by nB+d (step S256).

When the game system 10 has found a block number, the game system 10 determines the type X' (e.g., A) of electronic sound that corresponds to the template block indicated by the searched block number, the serial number N' (e.g., 1) of the template block indicated by the searched block number, and the sampling rate R' (e.g., 105.0) of the template block indicated by the searched block number (step S258). When the type X of electronic sound that corresponds to the template block indicated by the latest block number coincides with the type X' of electronic sound that corresponds to the template block indicated by the searched block number (Y in step S260), the difference between the serial number N of the template block indicated by the latest block number and the serial number N' of the template block indicated by the searched block number is n (Y in step S262), and the absolute value of the difference between the sampling rate R of the template block indicated by the latest block number and the sampling rate R' of the template block indicated by the searched block number is 2.5% or less (Y in step S264), the game system 10 updates the count value C of the block number counter (step S274). The game system 10 thus increments d by one (step S276). When d is larger than D (Y in step S278), the game system 10 increments n by one (i.e., designates to search a block number at a position that precedes the storage position of the latest block number by more than one block (30 frames)) (step S280). When a search block threshold value skip is larger than n (Y in step S282), the game system 10 determines whether or not the count value C of the block number counter has exceeded a threshold value c (step S284). When the count value C of the block number counter has exceeded the threshold value c (Y in step S284), the game system 10 determines the type X with a maximum number among the types X of template blocks indicated by the block numbers stored in the block number buffer to be the type of the electronic sound detected by the microphone 38 (step S286), and finishes the determination process. When the count value C of the block number counter has not exceeded the threshold value c (N in step S284), the game system 10 finishes the determination process without determining the type of the electronic sound detected by the microphone 38.

According to the first modification, it is unnecessary to add the serial number N of the template block indicated by the latest block number to the block number search range, and it is possible to omit the steps S166 to S172 of the determination process illustrated in FIG. 15.

5-2. Second Modification

The above embodiments and the first modification have been described taking an example of creating a template directly using the waveform data stored in the sound source IC of each toy. Note that the electronic sound may be output from each toy near the game system 10 illustrated in FIG. 1 or a recording device (e.g., personal computer), and the electronic sound output from each toy may be detected by the microphone of the game system 10 or the recording device. The waveform data obtained by detecting the electronic sound output from each toy by the microphone of the game system 10 or the recording device may be acquired.

The above embodiments have been described taking an example of creating template blocks in a number corresponding to the sampling period of the original waveform for each of the nine sampling rates. Note that template blocks may be created in a number corresponding to each of the nine sampling rates. For example, since the sampling period of the waveform data C (original waveform) is 11 seconds, the sampling period of the waveform data C+10 is 9.9 (=11×0.9) seconds. Therefore, when creating twenty-two template blocks corresponding to the waveform data C+10, the last two template blocks correspond to blank data (i.e., template elements are zero). Therefore, twenty template blocks may be created corresponding to the waveform data C+10 for which the sampling rate is +10% with respect to the waveform data C (original waveform). The sampling period of the waveform data C−10 is 12.1 (=11×1.1) seconds. Therefore, when creating twenty-two template blocks corresponding to the waveform data C−10, a template block is not created for 2.1 seconds at the end of the waveform data. Therefore, twenty-five template blocks may be created corresponding to the waveform data C−10 for which the sampling rate is −10% with respect to the waveform data C. Specifically, a template block corresponding to the waveform data may be created corresponding to each of the nine sampling rates.

In this case, when 75% of the template blocks in a number corresponding to each of the nine sampling rates satisfy the above conditions in the block number buffer, the waveform data corresponding to the block number may be determined to be the waveform data In of the external sound. For example, when twenty template blocks are created for the waveform data C+10, and block numbers C1+10 to C20+10 corresponding to the waveform data C+10 are stored in the block number buffer, the waveform data C may be determined to be the waveform data In of the external sound when fifteen template blocks (75% of twenty template blocks) satisfy the above conditions.

The above embodiments and the first modification have been described taking an example in which the first period is 0.5 seconds, and the second period is 1/60th of a second. Note that the first period and the second period may be arbitrarily set insofar as the first period is an integral multiple of the second period.

The above embodiments and the first modification have been described taking an example in which the image display control process is performed as the process corresponding to the type of electronic sound determined. Note that the sound output from the speaker 36 of the game system 10 may be controlled as the process corresponding to the type of electronic sound determined. For example, when the external sound detected by the microphone 38 has been determined to be the electronic sound output from one of the toys, the execution section may change the sound output from the speaker 36 based on the type of the electronic sound determined. For example, the execution section may cause the voice of a character corresponding to the type of the electronic sound determined to be output from the speaker 36. When the external sound detected by the microphone 38 has been determined to be the electronic sound output from one of the toys, the execution section may change the parameter used for the game process based on the type of the electronic sound determined. For example, the execution section may increase the parameter of a character corresponding to the type of the electronic sound determined.

The electronic sound output from the toy described in connection with the above embodiments and the first modification may include a sound (e.g., ultrasonic or infrasonic sound) other than an audible sound. A normal recording device cannot record an ultrasonic sound. Therefore, when recoding the sound output from the toy using such a recording device, an ultrasonic component cannot be reproduced. Therefore, an ultrasonic component may be included in the electronic sound output from the toy so that it is impossible to cause the game system 10 to perform the process corresponding to a preset sound using a sound obtained by recording a preset sound output from the toy. The game system 10 may specify an audible electronic sound from the external sound data, and determine whether or not the external sound detected by the microphone 38 is an electronic sound actually output from the toy by determining whether or not a sound other than an audible sound is included in the external sound data.

The game system 10 may determine whether or not a sound other than an audible sound is included in the external sound data by determining the presence or absence of an alias component that occurs when the microphone 38 has detected a sound other than an audible sound. A normal recording device removes an ultrasonic component detected by the microphone using a filter. However, an ultrasonic component can be acquired to a certain extent depending on the properties of the filter. In this case, the game system 10 is configured to be able to acquire an ultrasonic component to a certain extent. When the sampling rate of the game system 10 is low (less than twice the ultrasonic frequency), the game system 10 can acquire an ultrasonic component as an alias component. Therefore, the game system 10 determines that an ultrasonic component is present when having detected a frequency component corresponding to an alias component.

The above embodiments and the first modification have been described taking an example in which the sound input mode occurs based on a selection operation performed by the player. Note that the sound input mode may occur when the game system 10 has detected that the toy has been placed on the operation surface 39 that functions as a touch panel. In this case, since the electronic sound is output from the toy positioned near the microphone 38, the electronic sound can be easily determined (specified). In this case, characters (e.g., "Place the toy here") that instruct the player to place the toy on the operation surface 39 may be displayed on the first display screen 17.

The above embodiments and the first modification have been described taking an example in which each toy can output one type of electronic sound. Note that each toy may output a plurality of electronic sounds. In this case, a plurality of electronic sounds output from one toy may not be output from other toys.

A process using another method may be used as the comparative process or the determination process that has been described in connection with the above embodiments and the first modification.

The above embodiments and the first modification have been described taking an example in which a plurality of templates respectively corresponding to a plurality of electronic sounds are stored in the storage section. Note that a sound other than an electronic sound may also be used. For example, a toy that includes an analog record and a reproduction device, and reproduces a sound recorded on the analog record, a toy that performs a specific tune by blowing air into a whistle at a predetermined timing, a toy that plays a drum in a specific rhythm by beating the drum at a predetermined timing, or the like may be used, and a plurality of templates respectively corresponding to a plurality of preset sounds output from the toy may be stored in the storage section.

The above embodiments and the first modification have been described taking an example in which each of a plurality of toys outputs a sound that corresponds to the template. Note that the sound source is not limited to a toy, but may be an arbitrary shaped body that has a predetermined shape, such as a predetermined type of portable terminal.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A non-transitory information storage medium storing a program that causes a computer to function as:

a storage section that stores a plurality of templates respectively corresponding to a plurality of preset sounds generated by toys;

an acquisition section that acquires external sound data corresponding to an external sound detected by a sound detection section, wherein the external sound is output by a toy;

a determination section that compares the external sound data with the preset sounds of each of the plurality of templates, and determines the type of preset sound corresponding to the external sound; and an execution section that executes a process corresponding to the determined type of preset sound, wherein the preset sounds, with which the external sound data is compared, of each of the plurality of templates, have been created based on electronic sounds output from the toys.

2. The information storage medium as defined in claim 1, wherein the storage section stores a plurality of templates that respectively correspond to the plurality of preset sounds reproduced at different reproduction rates as the plurality of templates.

3. The information storage medium as defined in claim 2, wherein the storage section stores a plurality of template blocks respectively corresponding to a plurality of preset sound fragments that correspond to a first period and differ in start timing as each of the plurality of templates, each of the plurality of preset sound fragments forming each of the plurality of preset sounds;

wherein the acquisition section acquires an external sound data block every second period, the external sound data block corresponding to an external sound corresponding to the first period; and wherein the determination section compares the external sound data block with each of the plurality of template blocks each time the external sound data block is acquired.

4. The information storage medium as defined in claim 3, wherein the plurality of template blocks respectively correspond to the plurality of preset sound fragments that start at intervals of the first period.

5. The information storage medium as defined in claim 3, wherein the plurality of template blocks respectively correspond to the plurality of preset sound fragments that start at intervals of a period corresponding to the reproduction rate.

6. The information storage medium as defined in claim 3, wherein the determination section performs a process that selects a template block that satisfies a first condition with respect to the external sound data block, a process that determines whether or not an interval between acquisition timings satisfies a second condition when a template block that satisfies the first condition has been selected with respect to the external sound data block acquired at a different acquisition timing, and a process that determines the type of preset sound corresponding to the external sound based on the type of preset sound corresponding to the selected template block when the second condition has been satisfied.

7. The information storage medium as defined in claim 3, wherein the determination section performs a process that selects a template block that satisfies a first condition with respect to the external sound data block, a process that determines whether or not a difference in serial number between preset sound fragments that respectively correspond to selected template blocks satisfies a third condition when a template block that satisfies the first condition has been selected with respect to the external sound data block acquired at a different acquisition timing, and a process that determines the type of preset sound corresponding to the external sound based on the type of preset sound corresponding to the selected template block when the third condition has been satisfied.

8. The information storage medium as defined in claim 3, wherein the determination section performs a process that selects a template block that satisfies a first condition with respect to the external sound data block, a process that determines whether or not the reproduction rates of preset sound fragments that respectively correspond to selected template blocks satisfy a fourth condition when a template block that satisfies the first condition has been selected with respect to the external sound data block acquired at a different acquisition timing, and a process that determines the type of preset sound corresponding to the external sound based on the type of preset sound corresponding to the selected template block when the fourth condition has been satisfied.

9. A non-transitory information storage medium storing a program that causes a computer to function as:

a storage section that stores a plurality of templates that respectively correspond to preset sounds generated by a plurality of toys;

an acquisition section that acquires external sound data corresponding to an external sound detected by a sound detection section, wherein the external sound is output by a toy;

a determination section that compares the external sound data with the preset sounds of each of the plurality of templates, and determines the type of toy corresponding to the external sound; and an execution section that executes a process corresponding to the determined type of toy, wherein the preset sounds, with which the external sound data is compared, of each of the plurality of templates, have been created based on electronic sounds output from the toys.

10. An information processing system comprising:

a storage section that stores a plurality of templates respectively corresponding to a plurality of preset sounds generated by toys;

an acquisition section that acquires external sound data corresponding to an external sound detected by a sound detection section, wherein the external sound is output by a toy;

a determination section that compares the external sound data with the preset sounds of each of the plurality of templates, and determines the type of preset sound corresponding to the external sound; and an execution section that executes a process corresponding to the determined type of preset sound, wherein the preset sounds, with which the external sound data is compared, of each of the plurality of templates, have been created based on electronic sounds output from the toys.

11. The information processing system as defined in claim 10, wherein the storage section stores a plurality of templates that respectively correspond to the plurality of preset sounds reproduced at different reproduction rates as the plurality of templates.

12. The information processing system as defined in claim 11, wherein the storage section stores a plurality of template blocks respectively corresponding to a plurality of preset sound fragments that correspond to a first period and differ in start timing as each of the plurality of templates, each of the plurality of preset sound fragments forming each of the plurality of preset sounds;

wherein the acquisition section acquires an external sound data block every second period, the external sound data block corresponding to an external sound corresponding to the first period; and wherein the determination section compares the external sound data block with each of the plurality of template blocks each time the external sound data block is acquired.

13. The information processing system as defined in claim 12, wherein the plurality of template blocks respectively correspond to the plurality of preset sound fragments that start at intervals of the first period.

14. The information processing system as defined in claim 12, wherein the plurality of template blocks respectively correspond to the plurality of preset sound fragments that start at intervals of a period corresponding to the reproduction rate.

15. The information processing system as defined in claim 12, wherein the determination section performs a process that selects a template block that satisfies a first condition with respect to the external sound data block, a process that determines whether or not an interval between acquisition timings satisfies a second condition when a template block that satisfies the first condition has been selected with respect to the external sound data block acquired at a different acquisition timing, and a process that determines the type of preset sound corresponding to the external sound based on the type of preset sound corresponding to the selected template block when the second condition has been satisfied.

16. The information processing system as defined in claim 12, wherein the determination section performs a process that selects a template block that satisfies a first condition with respect to the external sound data block, a process that determines whether or not a difference in serial number between preset sound fragments that respectively correspond to selected template blocks satisfies a third condition when a template block that satisfies the first condition has been selected with respect to the external sound data block acquired at a different acquisition timing, and a process that determines the type of preset sound corresponding to the external sound based on the type of preset sound corresponding to the selected template block when the third condition has been satisfied.

17. The information processing system as defined in claim 12, wherein the determination section performs a process that selects a template block that satisfies a first condition with respect to the external sound data block, a process that determines whether or not the reproduction rates of preset sound fragments that respectively correspond to selected template blocks satisfy a fourth condition when a template block that satisfies the first condition has been selected with respect to the external sound data block acquired at a different acquisition timing, and a process that determines the type of preset sound corresponding to the external sound based on the type of preset sound corresponding to the selected template block when the fourth condition has been satisfied.

18. An information processing system comprising:

a storage section that stores a plurality of templates that respectively correspond to preset sounds generated by a plurality of toys;

an acquisition section that acquires external sound data corresponding to an external sound detected by a sound detection section, wherein the external sound is output by a toy;

a determination section that compares the external sound data with the preset sounds of each of the plurality of templates, and determines the type of toy corresponding to the external sound; and an execution section that executes a process corresponding to the determined type of toy, wherein the preset sounds, with which the external sound data is compared, of each of the plurality of templates, have been created based on electronic sounds output from the toys.

19. The information storage medium as defined in claim 1, wherein the plurality of templates stored in the storage section respectively correspond to the plurality of preset sounds having sampling rates that are different from each other.

* * * * *